US009527613B2

(12) United States Patent
Bazany et al.

(10) Patent No.: US 9,527,613 B2
(45) Date of Patent: Dec. 27, 2016

(54) METHOD OF LOADING PRODUCT FROM CONTAINER HAVING MOVABLE POUCHES

(71) Applicant: Bradford Company, Holland, MI (US)

(72) Inventors: Donald J. Bazany, Grand Haven, MI (US); Judson A. Bradford, Holland, MI (US); Timothy A. Bublitz, Grand Haven, MI (US); Brian T. Dobrinski, Zeeland, MI (US); Mark J. Feenstra, Grand Haven, MI (US); Calvin D. Nyeboer, Holland, MI (US)

(73) Assignee: Bradford Company, Holland, MI (US)

( * ) Notice: Subject to any disclaimer, the term of this patent is extended or adjusted under 35 U.S.C. 154(b) by 628 days.

(21) Appl. No.: 13/900,807

(22) Filed: May 23, 2013

(65) Prior Publication Data

US 2013/0239526 A1 Sep. 19, 2013

Related U.S. Application Data

(63) Continuation of application No. 11/225,904, filed on Sep. 14, 2005, now abandoned, and a (Continued)

(51) Int. Cl.
*B65B 5/00* (2006.01)
*B65B 67/00* (2006.01)

(Continued)

(52) U.S. Cl.
CPC ..... *B65B 5/00* (2013.01); *B65B 67/00* (2013.01); *B65D 1/22* (2013.01); *B65D 25/06* (2013.01);

(Continued)

(58) Field of Classification Search
CPC ..... B65B 67/00; B65B 67/02; B65B 67/12; B65B 67/1211; B65B 67/1205; B65B 67/1222;B65B 67/1227; B65B 67/1244; B65B 5/108; B65B 5/04; B65B 5/045; B65B 5/06; B65B 5/061; B65B 5/067; B42F 17/02–17/16; B42F 15/00–15/0064; B42F 15/0088; B42F 15/0094; B42F 15/02; B42F 15/026; B42F 15/063; B65D 25/04; B65D 25/06; B65D 88/58; B65D 88/60; B65D 88/62; B65D 2519/0094; B65D 2519/00935; B65D 2519/00955; B65D 1/225; B65D 19/12; B65D 21/086; B65D 2585/6882–2585/6887; A47B 57/583–57/586; A47B 81/067; B60R 2021/065

(Continued)

(56) References Cited

U.S. PATENT DOCUMENTS 1,712,168 A 5/1929 Rand, Jr.
1,870,763 A * 8/1932 Znidersic ..... A47B 53/00 211/184

(Continued)

FOREIGN PATENT DOCUMENTS

DE 19549166 3/1997
DE 20101374 4/2001

(Continued)

*Primary Examiner* — Stephen F Gerrity
*Assistant Examiner* — Joshua Kotis
(74) *Attorney, Agent, or Firm* — Wood, Herron & Evans, LLP

(57) ABSTRACT

The present invention provides a container for holding product therein during shipment and being returned for reuse that has a body, tracks attached to opposite sides of the body, and a plurality of support members extending between the tracks. Sliders are located at the ends of tubular supports, the sliders being slidable in the tracks to move the support (Continued)

members. The support members support dunnage for supporting products for storage or shipment.

18 Claims, 18 Drawing Sheets

Related U.S. Application Data continuation-in-part of application No. 11/122,686, filed on May 5, 2005, now abandoned.

(51) Int. Cl.

| | |
|---|---|
| ***B65D 1/22*** | (2006.01) |
| ***B65D 25/06*** | (2006.01) |
| ***B65D 25/10*** | (2006.01) |
| ***B65D 81/02*** | (2006.01) |
| ***B65D 81/07*** | (2006.01) |

(52) U.S. Cl.

CPC ..... *B65D 25/10* (2013.01); *B65D 81/02* (2013.01); *B65D 81/07* (2013.01); *B65D 2585/6882* (2013.01)

(58) Field of Classification Search

USPC ... 53/443–445, 467–469, 473–475; 312/184, 186, 221, 257.1, 258, 260, 261, 312/265.3, 270.3, 270.2, 273–274, 304, 312/321–323, 334.23, 348.3, 348.5, 3–6, 301, 312/330.1–348.2; 206/485, 736, 756–758, 335, 206/319, 521, 588, 589; 220/495.01, 500, 507, 220/503, 525, 528, 529, 531, 534, 535, 544; 211/162, 184, 45, 46, 10–12; 322/85.8

See application file for complete search history.

(56) References Cited

U.S. PATENT DOCUMENTS

| | | | | | |
|---|---|---|---|---|---|
| 2,350,754 | A * | 6/1944 | Guichard | B42F 15/0035 | 211/126.13 |
| 2,684,277 | A * | 7/1954 | Hamacher | A47B 63/00 | 312/198 |
| 2,721,780 | A * | 10/1955 | Peterson | A47B 63/02 | 312/293.1 |
| 3,098,488 | A * | 7/1963 | Schnelie | B42F 15/0094 | 211/126.13 |
| 3,172,711 | A * | 3/1965 | Gillotte | A47B 63/00 | 211/153 |
| 3,630,387 | A * | 12/1971 | Wehner | B42F 15/0094 | 211/194 |
| 3,729,242 | A * | 4/1973 | Barney | A47B 67/04 | 312/107 |
| 3,850,488 | A * | 11/1974 | Elias | B42F 15/0058 | 211/45 |
| 4,527,694 | A * | 7/1985 | Bolt | H05F 3/02 | 211/162 |
| 4,685,571 | A | 8/1987 | Hoss | | |
| 4,770,314 | A | 9/1988 | Giesler | | |
| 4,864,686 | A | 9/1989 | Lasier et al. | | |
| 4,988,006 | A * | 1/1991 | Lundin | B42F 15/0035 | 211/45 |
| 5,211,290 | A * | 5/1993 | Janus | B65D 81/07 | 206/583 |
| 5,238,139 | A | 8/1993 | Bisceglia | | |
| 5,251,973 | A * | 10/1993 | Hazan | A47B 61/00 | 211/186 |
| 5,324,105 | A | 6/1994 | Christensen | | |
| 5,407,262 | A * | 4/1995 | Christian | A47B 47/0008 | 108/190 |
| 5,511,675 | A * | 4/1996 | Frederick | A47B 63/00 | 211/162 |
| 5,560,507 | A | 10/1996 | Arpin et al. | | |
| 5,725,119 | A * | 3/1998 | Bradford | B65D 1/225 | 206/583 |
| 5,813,566 | A * | 9/1998 | Bradford | B65D 19/18 | 206/298 |
| 5,815,903 | A | 10/1998 | Foster et al. | | |
| 6,062,410 | A | 5/2000 | Bradford et al. | | |
| 6,164,440 | A * | 12/2000 | Van Bree | B65D 19/44 | 198/715 |
| 6,202,884 | B1 * | 3/2001 | Verkerke | B65D 11/18 | 206/583 |
| 6,230,916 | B1 | 5/2001 | Bradford et al. | | |
| 6,352,157 | B1 * | 3/2002 | Srinivasan | B42F 15/0094 | 206/425 |
| 6,464,092 | B1 * | 10/2002 | Kortman | A47B 46/00 | 211/162 |
| 6,540,096 | B1 | 4/2003 | Bazany et al. | | |
| 2006/0249415 | A1 | 11/2006 | Nyeboer et al. | | |
| 2006/0249514 | A1 | 11/2006 | Bazany et al. | | |
| 2008/0047917 | A1 * | 2/2008 | Hernandez | B65D 90/0073 | 211/180 |

FOREIGN PATENT DOCUMENTS

| | | | | |
|---|---|---|---|---|
| FR | 1455414 | | 4/1966 | |
| FR | EP 0865991 | A1 * | 9/1998 | B65D 7/26 |
| FR | 2860504 | | 4/2005 | |
| JP | 6-59230 | | 8/1994 | |

* cited by examiner

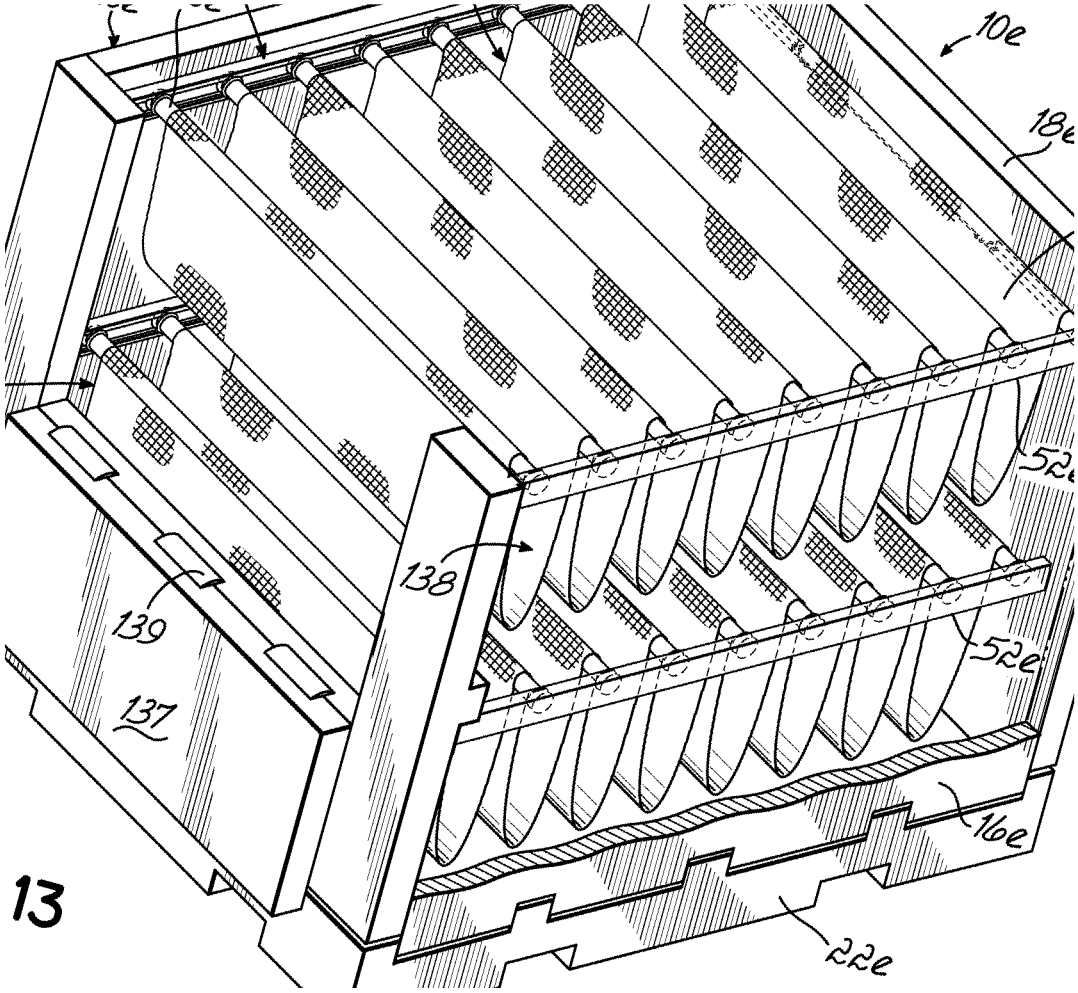
13

METHOD OF LOADING PRODUCT FROM CONTAINER HAVING MOVABLE POUCHES

CROSS-REFERENCE TO RELATED APPLICATIONS

This application is a continuation of U.S. patent application Ser. No. 11/225,904, filed Sep. 14, 2005 entitled "Container Having Sliding Support Member Assemblies For Supporting Dunnage", which is fully incorporated by reference herein. U.S. patent application Ser. No. 11/225,904 is a continuation-in-part of U.S. patent application Ser. No. 11/122,686, filed May 5, 2005 entitled "Container Having Sliding Support Members", now abandoned, which is fully incorporated by reference herein.

FIELD OF THE INVENTION

The present invention relates to containers for use in shipping and, more particularly, to containers with movable members for supporting product.

BACKGROUND OF THE INVENTION

A large number of different container structures are utilized by manufacturers to ship a variety of different products to end users, which may be, for example, assembly plants. In the automobile industry, for example, an assembly plant assembling a particular automobile might utilize a number of different parts from different manufacturers. These manufacturers ship their respective parts to the assembly plant in container structures where the parts are then removed from dunnage or support members inside the container structure and assembled into a finished automobile.

Access to the product in the containers is of particular concern. Specifically, in the automotive industry, the containers full of product are positioned on an assembly line adjacent to a work area which is associated with a particular product to be installed on a manufactured vehicle. For example, a container full of interior door panels is usually positioned next to a particular station on an assembly line where interior door panels are installed so that a line worker may easily access the door panels inside the container. The product or part is taken directly from the container and used on the line. Some existing containers are difficult to access which makes removal of the parts therein difficult and time consuming. For example, some containers are configured so that a line worker must walk around the container to remove parts or products from opposite ends of the container. As may be appreciated, a line worker only has a certain amount of time to install a part. Any delay in access and removal of the part from the container is undesirable.

In many containers, a line worker or employee must insert or remove parts from a distal or rear part of the container. The size and/or weight of the parts or work pieces may cause stress or strain on the line worker and, more particularly, on the back of the worker when inserting or removing parts from such a container. Such ergonomically unfriendly movements may cause physical trauma, pain and other injuries that may lead to lost production time.

In some situations, in order to alleviate such stress and/or strain on his or her body, the line worker may move to the rear or opposite end of the container to remove parts from inside the container. This requires space around the container which may not be available, depending on the physical layout of the plant or facility. The length (front to back) of certain containers may be limited because the container manufacturer needs to eliminate the need for a line worker to walk around the container to remove product from inside the container. Such containers having a reduced length reduce the number of parts or products which may be shipped and/or stored in the container. The more containers needed to ship a predetermined number of parts, the greater the cost to the shipper.

In other containers, such as containers having multiple layers or level of parts, a line worker or employee must lean forward and bend down into the container to insert or remove a part or work piece from the bottom of the container. This movement by the line worker is ergonomically unfriendly because the line worker must lean forward and bend down into the container to insert or remove a part or work piece from the bottom of the container. This movement is necessary with many top loading containers.

Depending upon the number of times the line worker repeats this unnatural motion into the interior of the container, strain in the back, legs and arms may result. The size and/or weight of the parts or work pieces may increase the strain on the line worker. Thus, simply removing multiple parts during a work day may cause physical trauma, pain and other injuries that may lead to lost production time.

Accordingly, there is a need for a container which prevents employees from walking around the container to insert or remove product from inside the container.

There is further a need for a container which prevents employees from having to perform difficult or straining repetitive reaching motions.

There is further a need for a container which brings product into an ergonomically friendly area or zone for insertion or removal of the product.

There is further a need for a container which may be designed for a particular application with increased product density.

SUMMARY OF THE INVENTION

The present invention provides a container for holding product therein during shipment that has a body, tracks or retainers supported by the body, and a plurality of support members or support member assemblies that are supported by the tracks or retainers. For purposes of the present invention, the terms "support member" and "support member assembly" may be used interchangeably; either may be a unitary member or include multiple components secured together. For example, a "support member" may comprise in combination a wooden bar and a fabric cover surrounding the wooden bar or a multiple piece assembly having slidable members which move or slide inside tracks or retainers. Any number of such combinations is possible with the present invention.

Similarly, for purposes of the present invention, the terms "track" and "retainer" may be used interchangeably; either may be a unitary member or multiple components secured together. The present invention is not intended to be limited to the tracks like those illustrated and described below. For example, a "track" may comprise a groove in one or more walls of a container or a linear rod secured to one or more walls of a container. The terms "tracks" and "retainers" are intended to include any number of objects along which support members or support member assemblies, as defined or illustrated in the present document, may slide or move.

The container may be collapsible, such as the containers illustrated in U.S. Pat. Nos. 5,725,119; 6,062,410; 6,230,916; and 6,540,096, all of which are fully incorporated herein. Alternatively, the container may be non-collapsible, such as what is known in the industry as a pallet box. Furthermore, the container may have any number of wall structures, including four wall structures or only two opposed wall structures.

In at least one embodiment, at least some of the support members have rollers attached to their ends. The rollers are adapted to roll in the tracks or retainers. The support members also have a plurality of product receptacles whereby products may be suspended between the support members. Typically, a portion of the product resides in or is secured in the product receptacles. These product receptacles or notches may be particularly sized and located as to mate or correspond with a portion of a particular product or a particular appendage of a product. Due to the location and/or orientation of these product receptacles, more parts or products may fit inside the container because the distance between adjacent support members may be reduced. Increase product density inside a container increases efficiency in transporting more parts and therefore reduces shipping costs.

The container may also include at least one space limiter attached to the support members to limit the distance adjacent support members may be moved or separated from each other. One acceptable space limiter is a plastic strap or like component that can flex when the distance between the support members is minimized and yet only allow the support members to move a predetermined distance apart from each other. Another space limiter may be the fabric of the dunnage itself, as will be described in more detail below. Other materials may be used if desired.

In certain embodiments, the container further comprises stabilizers which act on the support members to prevent their rotation. These stabilizers may be solid rods or hollow tubes or like components. In one embodiment of the present invention, the stabilizers pass through apertures or holes in the support members and allow the support members to freely slide along or over the stabilizers. However, the stabilizers, while allowing the support members to move along or over them, prevent the support members from rotating relative to a horizontal axis. Hence, the stabilizers insure that the support members remain in a desired generally vertical orientation at all times so that product does not fall between adjacent support members due to rotation of one or more of the support members. In alternative embodiments, the stabilizers may not pass through the support members, but rather be operatively coupled to them in any desired manner or fashion. For example, the stabilizers may pass through clips or retainers secured to the support members.

The container of the present invention is adapted so that an operator located at the front of the container may pull product to be emptied from the rear of the container forwardly to a more ergonomically friendly position after a row of products suspended by and contacting the two forwardmost support members, named proximal and medial support members for purposes of this document, have been unloaded or removed. Thus, a person unloading the container from the front or proximal location of the container will not have to stretch or reach to the back of the container to unload remaining product.

Similarly, a person loading the container from the front of the container need not stretch or reach to the back of the container to insert or load product into the container. The loader of the container may push the support members already loaded with rows of product rearwardly and load additional product in a more ergonomically friendly position or manner. For example, after a row of products is loaded between two support members, i.e., a distal or first and second or medial support member, these support members are pushed rearwardly to enable the loader to load an additional row of product between the medial support member and a third or proximal support member. Thus, the present invention allows product to be more efficiently and safely removed from these containers or inserted therein without unnecessary stress or strain on the unloader or loader.

Moreover, because the product receptacles are located at or near the top of the support members, products may be easily accessed. In other words, the product receptacles keep the product in an optimum location for removal by an unloader or insertion by a loader.

In an alternative embodiment of the present invention, the rollers are omitted from the support member assemblies. In this embodiment, the sides of the container body need not have tracks or retainers. The support members slide along stabilizers which are preferably secured to opposed sides of the container body, but may be located in the container in any desired manner.

In another embodiment of the present invention, preferably used in collapsible containers, support member assemblies comprise elongate flexible supports and sliders at the ends thereof. The supports, in one embodiment, are cables, but may be made of any other flexible material. The sliders are preferably made of plastic, but may be made of desired material. In this embodiment, the sides of the container have tracks or retainers in which the sliders slide to move dunnage supported by the support members closer to the user for loading or unloading product from inside the dunnage. Each slider has at least one head located inside the interior of the track so the slider remains engaged with the track or retainer. The slider may have another head outside the track for preventing the dunnage material from entering the interior of the track or retainer.

In another embodiment of the present invention, preferably used in non-collapsible containers, support member assemblies comprise elongate tubular supports secured to sliders at the ends thereof. The tubular supports, in one embodiment, are made of metal, but may be made of any other suitable material, such as plastic. The sliders are preferably made of plastic, but may be made of any desired material. In this embodiment, the sides of the container have tracks or retainers in which the sliders slide to move dunnage supported by the support members closer to the user for loading or unloading product from inside the dunnage. Each slider has at least one head located inside the interior of the track so the slider remains engaged with the track or retainer. The slider may have another head outside the track for preventing the dunnage material from entering the interior of the track or retainer. The tracks may have openings therein and removable caps for covering and/or closing the openings. If one or more of the supports or support member assemblies needs to be removed, a person may remove the support member assemblies via the openings in opposed tracks.

According to another aspect of the present invention, a plurality of tracks or retainers are attached to the container at different heights. In such embodiments, multiple layers or levels of product may be shipped in a single reusable and returnable container. The container may be collapsible, such as the containers illustrated in U.S. Pat. Nos. 5,725,119; 6,062,410; 6,230,916; and 6,540,096, or the container may be a non-collapsible container. Multiple levels allows for maximizing the number of parts which may be shipped in a container as well as ensuring that the product will be able to be moved to an ergonomically friendly area or zone within the container prior to its removal by an unloader and/or insertion by a loader.

For example, once an upper layer of product is removed, all the support members of the upper layer may be pushed to the rear of the container, thus exposing a lower layer of product supported by a lower set of slidable support members. The lower layer of product may be removed and the lower support members continually moved toward the unloader to insure that the lower layer of product remains as close as possible to the unloader prior to it being unloaded. Similarly, once a lower layer of products is loaded or inserted into the container, another upper layer of products may be loaded in a manner which does not cause unnecessary stress or strain on the body of the individual loading the container. The container of the present invention is not limited to two layers; the container may have any number of such layers.

According to the method of the present invention for unloading a product from a container, an unloader first removes product suspended between opposing product receptacles, a first product receptacle being located in a proximal support member and a second product receptacle being located in a medial support member. Once all the product that is suspended between the proximal and medial support members has been removed, the medial support member is rolled or moved alongside the proximal support member so that both members are located nearest to the front of the container, i.e., where the unloader is positioned. The unloader then removes the next row of product that is suspended between product receptacles in the medial member and product receptacles of a distal member. Once all the product in this row is removed, the distal member is rolled or moved to a position nearest to the unloader, i.e., alongside the medial member. If the container contains additional support members, the process continues until all rows of the container have been unloaded.

Similarly, product may be easily and quickly loaded into a reusable and returnable container using the present invention. A loader first loads product so that the product is suspended between opposing product receptacles, the first product receptacle being located in a distal support member and the second product receptacle being located in a medial support member. Once a row of product has been suspended between the distal and medial support members, the distal and medial support members are rolled or moved away from the loader so that another row of products may be loaded into the receptacles of the next two support members, a proximal support member and the medial support member. The loader then inserts the next row of product so that it is suspended between product receptacles of the proximal and medial support members. Once all the product in this row is inserted, the proximal and medial support members are rolled or moved away from the loader, i.e., to the rear of the container. If the container contains additional support members, the process continues until all support members of the container have been loaded with product being suspended therefrom.

In an alternative embodiment of the present invention that contains multiple layers of product, after the upper layer or level of products have been removed or unloaded, the unloading process continues by moving all of the upper support members, i.e., the proximal, medial and distal members, to a position that is farthest from the unloader. A lower layer of product is thus exposed, and an unloader may remove additional product that is suspended between product receptacles in a lower proximal support member and product receptacles of a lower medial support member. Once all product in this lower row is removed, the lower medial member is rolled alongside the lower proximal member so that both members are positioned nearest to the unloader. The unloader may then remove additional product suspended between product receptacles of a lower medial member and product receptacles of a lower distal member. The unloader continues the process of unloading rows of product and sliding, rolling or moving the support members toward the unloader until all product in that particular layer has been unloaded. Any number of layers of product may be unloaded in such a manner.

The method of loading the container that contains multiple layers of product comprises loading one layer at a time. The process begins by moving all of the upper support members, i.e., the proximal, medial and distal support members for supporting the upper layer of product to a position that is farthest from the unloader so they do not interfere with loading the lower layer. A lower layer of support members is thus exposed, and a loader may insert product between the support members of the lower layer so that the product is suspended between product receptacles of these lower support members. Once all of the product receptacles in the support members of this lower layer have been fully loaded or filled, the upper support members are moved to the front of the container proximate the loader. The loader may then insert additional product between the upper support members, the additional products being suspended by product receptacles formed in the upper support members. The loader continues the process of loading rows of product and sliding, rolling or moving the support members away from the loader until all product in that particular upper layer has been loaded. Any number of layers of product may be loaded in such a manner. The methods of loading and unloading product may be used with any embodiment of the present invention, including those incorporating dunnage hanging from support members.

The above and other objects and advantages of the present invention shall be made apparent from the accompanying drawings and the brief description thereof.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

FIG. 13 is a perspective view of another embodiment of collapsible reusable and returnable container showing multiple layers of dunnage suspended by a plurality of support member assemblies;

DETAILED DESCRIPTION OF THE INVENTION

Figure 1:
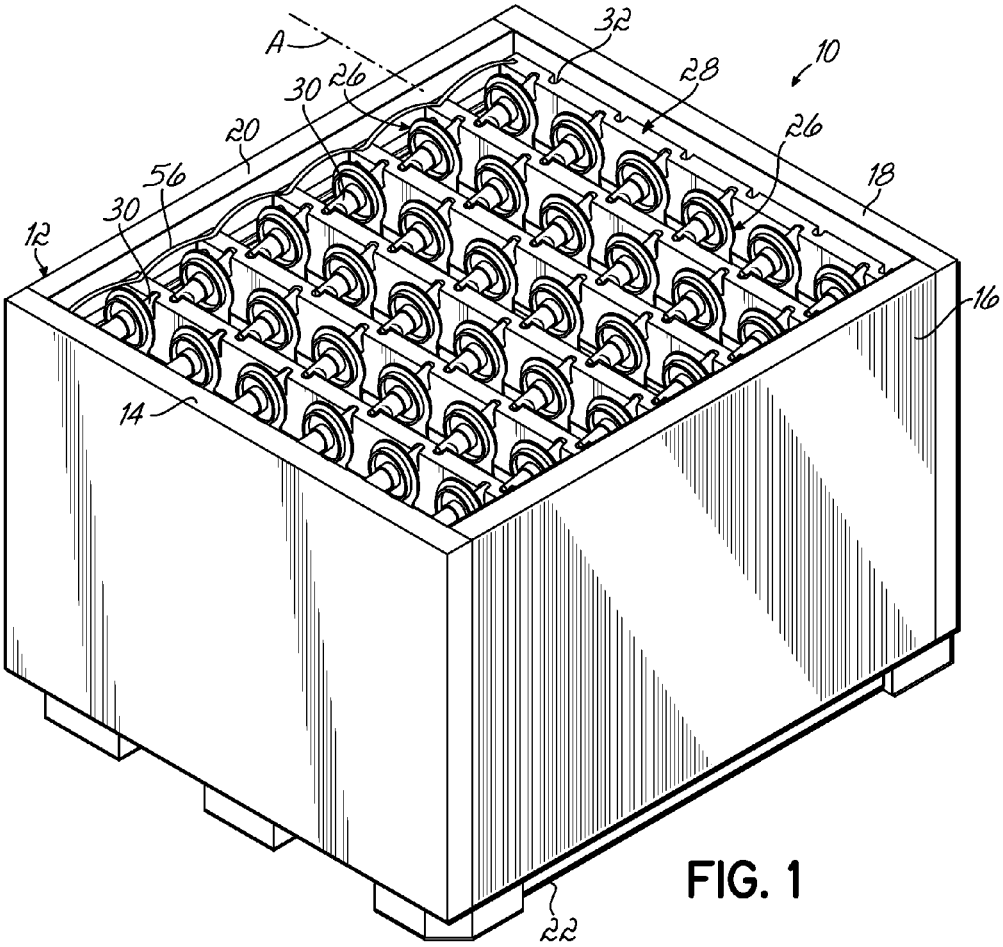
FIG. 1 is a perspective view of a preferred embodiment of the reusable and returnable container of the present invention showing product being suspended by a plurality of support members.

Referring to FIG. 1, there is illustrated a reusable and returnable container 10 according to one embodiment of the present invention. The reusable and returnable container 10 as shown, comprises a body 12 having a front wall 14, a side wall 16, a rear wall 18 and another side wall 20, all extending upwardly from a base 22. Although one type of container is illustrated, the present invention may be used with any type or configuration of box or container. For example, the present invention may be used in a container in which one or more of the walls of the container is hinged for the container to be more easily erected and/or compacted for storage. The present invention may also be used in a rack-type of container which has four corner posts extending upwardly from a base. A cover (not shown) may also be included to enclose the container 10 and further protect and secure product 26 during shipment.

Products 26 are suspended by and supported by a plurality of support members 28. Although one configuration of support member 28 is illustrated, the present invention may be used with any type or configuration of support member. A portion or appendage 30 of the product 26 is specifically received in and/or secured in a product receptacle 32 in one support member 28, and another portion or appendage 30 of the same product 26 is located in a product receptacle 32 of an adjacent support member 28. See FIG. 2. These product receptacles or notches 32 are particularly machined or sized and located to receive, mate and/or hold the portion or appendages 30 of the product 26. The product receptacles furthermore are located and sized so that a specific number of products may fit snugly inside the container 10 without moving or shifting during shipment. Although one configuration of product 26 is illustrated and described, the present invention may be used to store and ship other configurations of products not shown or described. Similarly, depending on the configuration of the product, the product receptacles or notches formed in the support members may be shaped or configured differently than those shown and described.

Figure 5A:
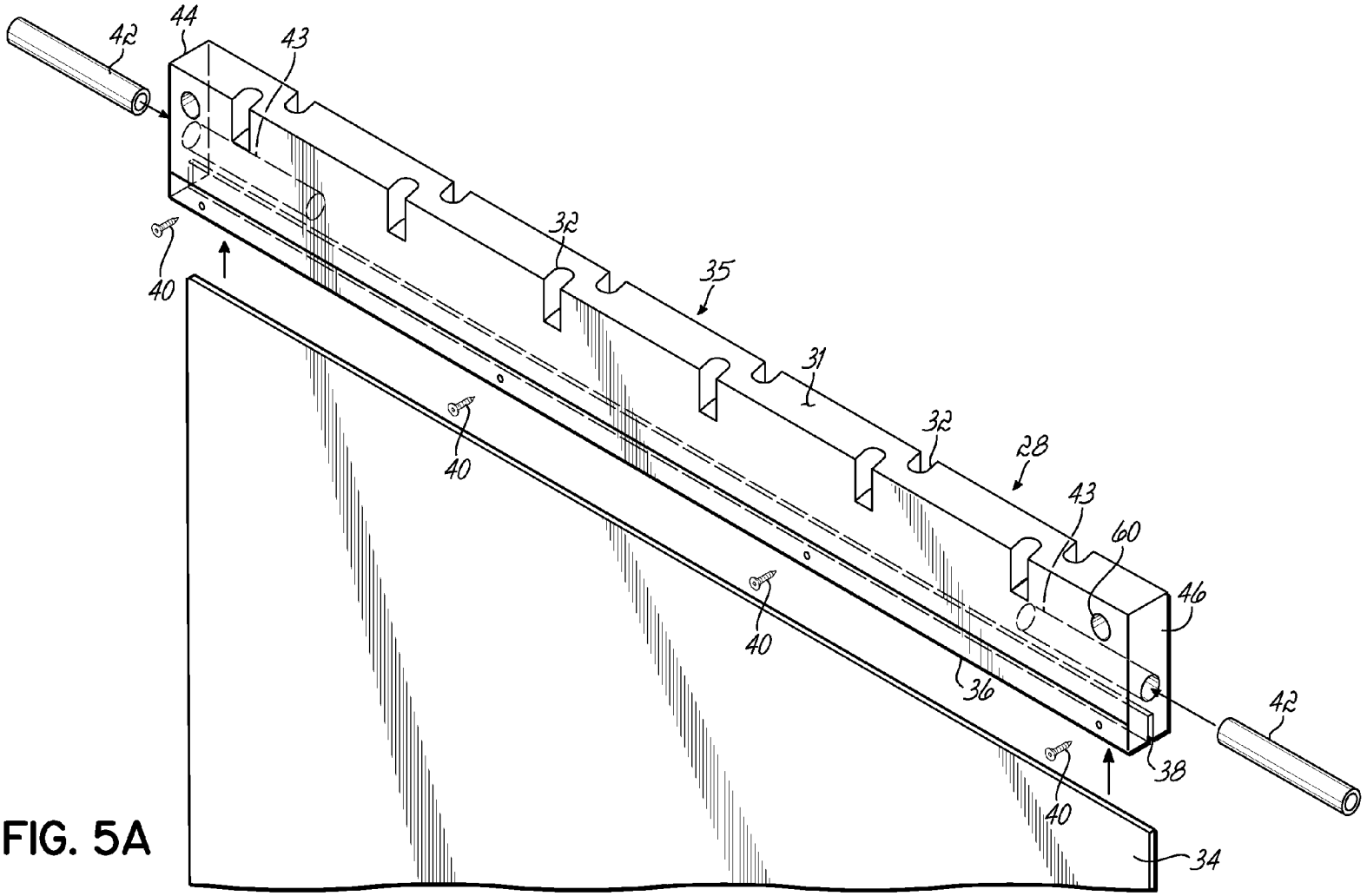
FIG. 5A is a partially disassembled perspective view of a portion of one of the support member assemblies shown in FIGS. 1-4.

As shown in FIGS. 1A, 5A, 5B and 5C, a support member assembly 35 includes a divider 34 attached to the bottom 36 of the support member 28 and suspended therefrom. As shown in FIG. 5A, the divider 34 may be mounted to the lower end 36 of the support member 28 by being inserted into a longitudinally extending groove 38 formed in the support member 28 and secured therein with a plurality of fasteners 40, such as screws, rivets, nails or the like. An adhesive, such as glue, may also be used to help secure the divider 34 to the support member 28, if desired. Any other suitable means of securing the divider 34 to the support member 28 may be used as desired. The dividers 34 prevent adjacent products 26 from contacting one another and being dented or otherwise damaged.

Figure 5B:
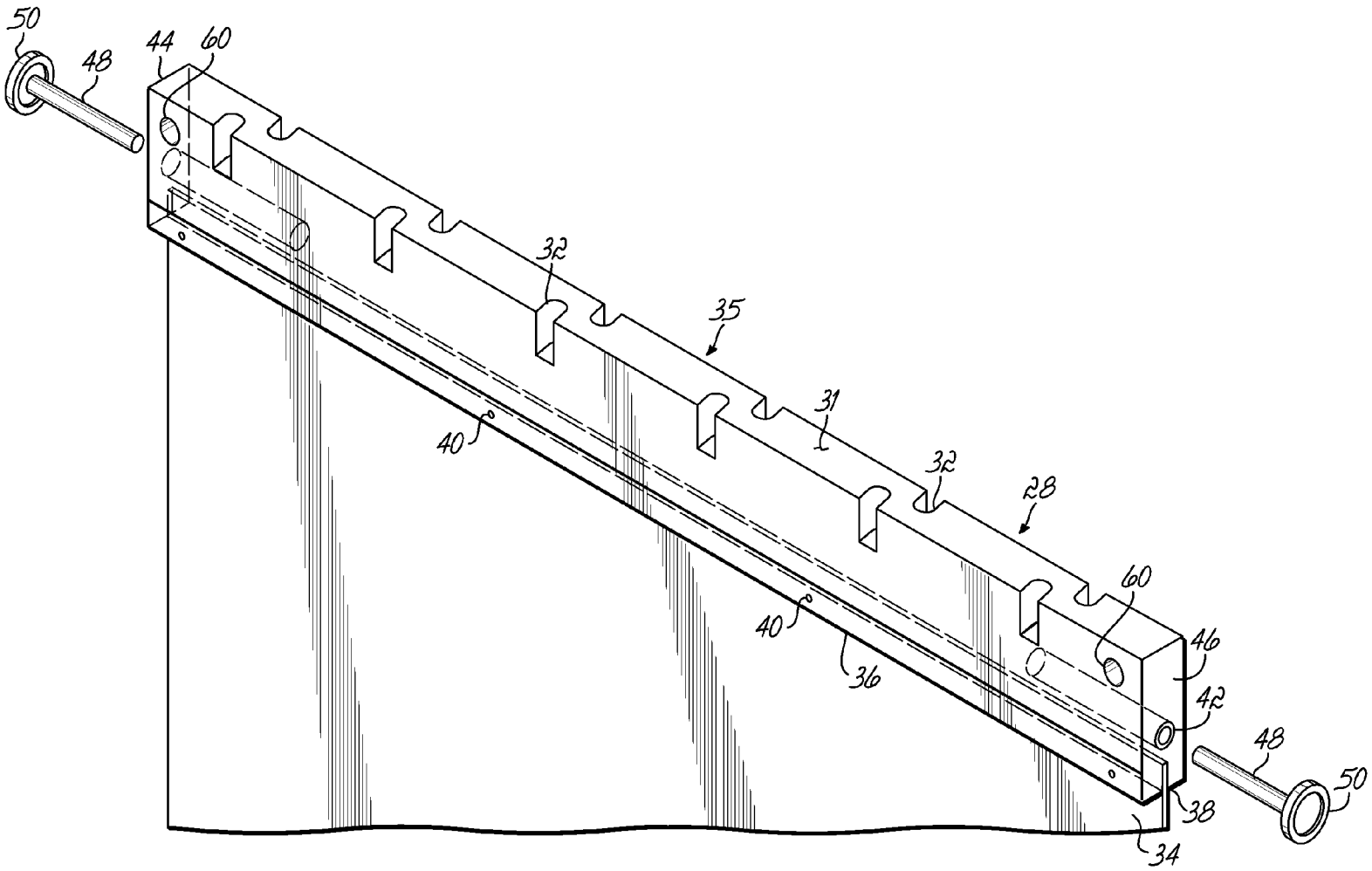
FIG. 5B is a partially disassembled perspective view of the support member assembly shown in FIG. 5A, including rollers at each end of the support member.
Figure 5C:
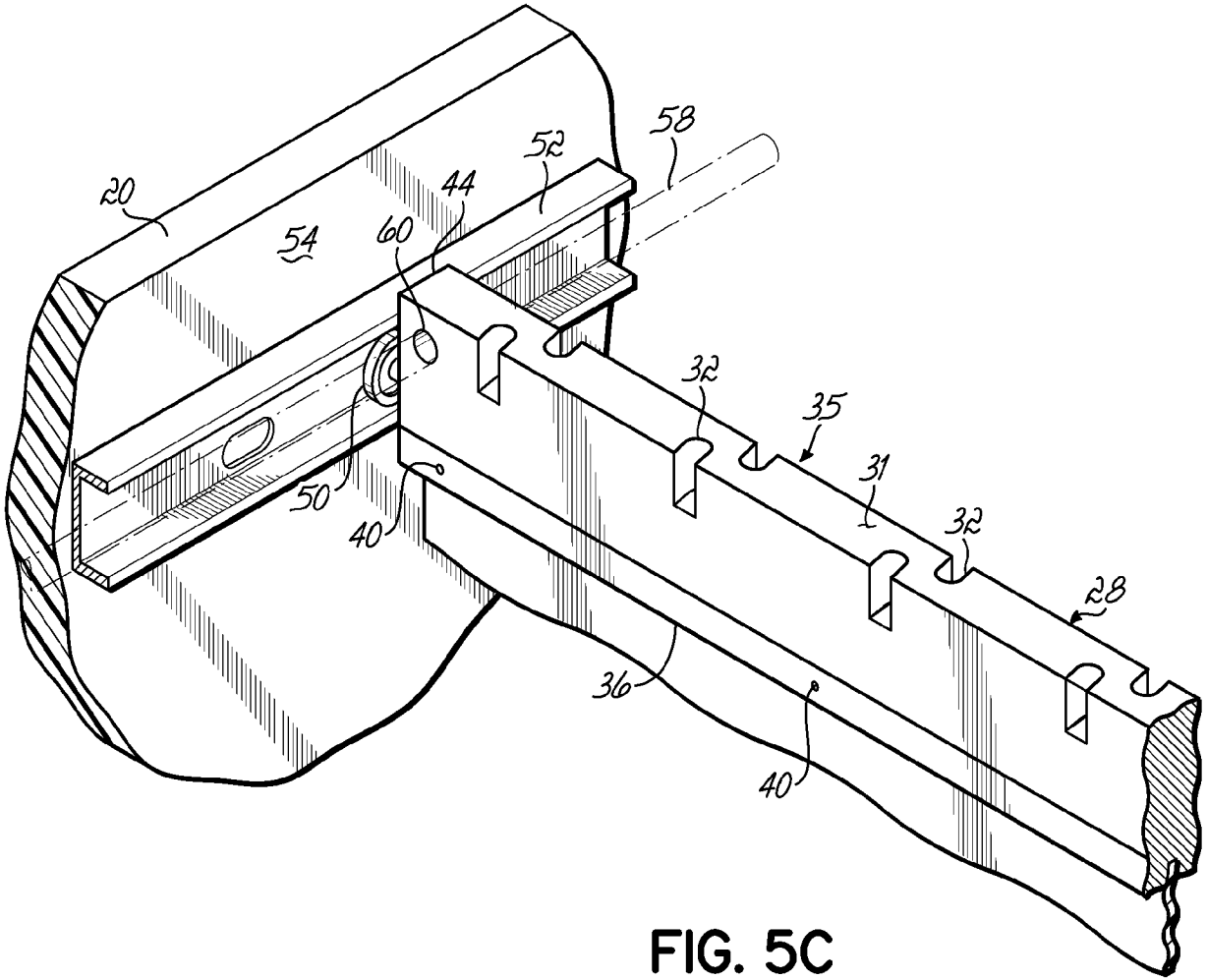
FIG. 5C is a perspective view of a portion of the support member assembly shown in FIGS. 5A and 5B showing the roller at the end of the support member being in a track attached to the body of the container.

As also shown in FIG. 5A, tubes 42 are inserted in holes 43 formed in opposed ends 44, 46 of the support member 28 to further complete the support member assembly 35. As shown in FIG. 5B, these hollow tubes 42 are used as receptacles for rotatably receiving the axles 48 of the rollers 50. As shown in FIG. 5C, rollers 50 are adapted to roll or move in channels or tracks 52 attached to the interior surfaces 54 of the side walls 20, 16 of the container 10. FIG. 5C illustrates one roller 50 at end 44 of the support member 28 rotatably received in a track 54 secured to side wall 20. A roller 50 at the other end 46 of the support member 28 is likewise supported in a track 52, which is attached to side wall 16 of the container 10. Although one configuration of track 52 and roller 50 is shown and described, other types of rollers and tracks may be used if desired, such as the one illustrated in FIG. 5D.

Figure 2:
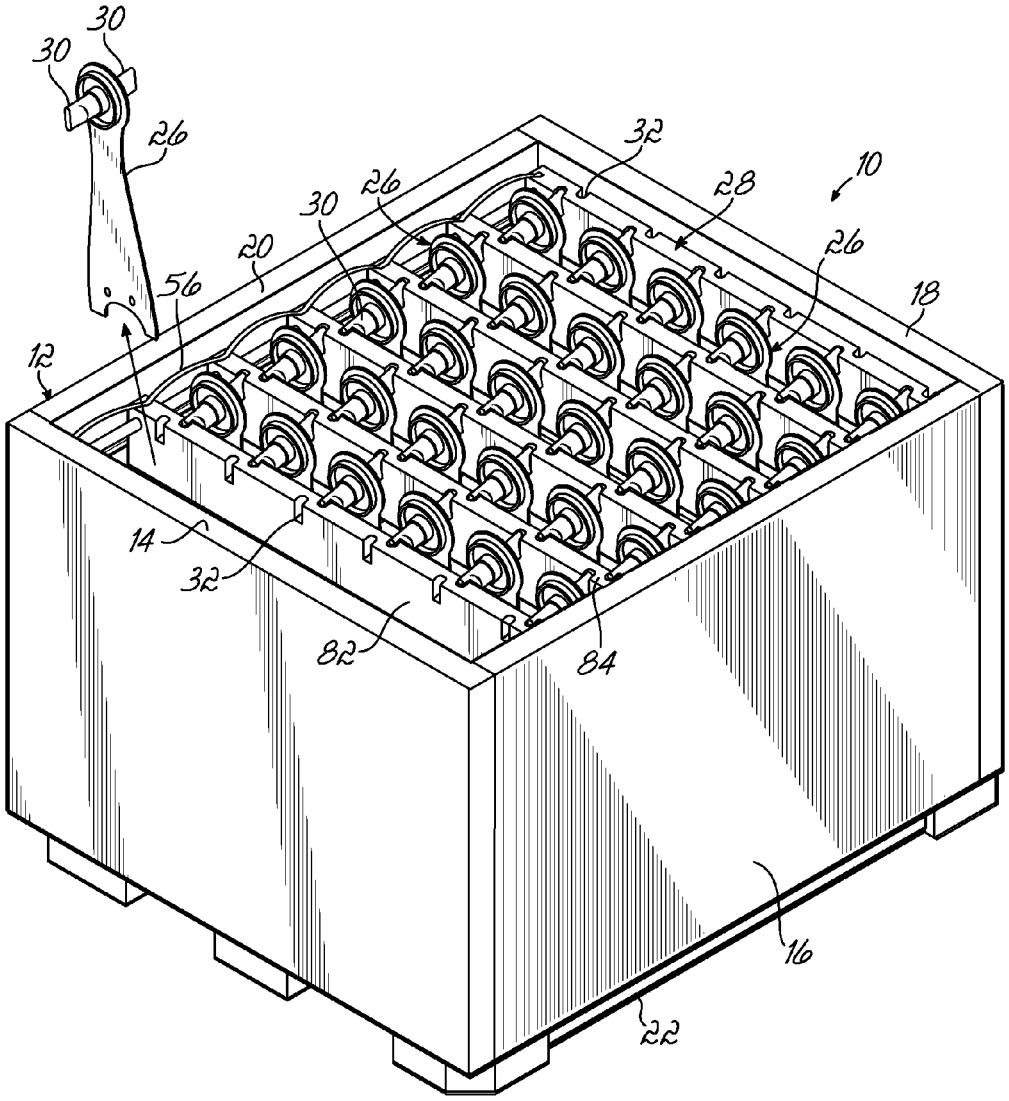
FIG. 2 is a perspective view of the reusable and returnable container shown in FIGS. 1 and 1A showing a product being removed from the container.
Figure 3:
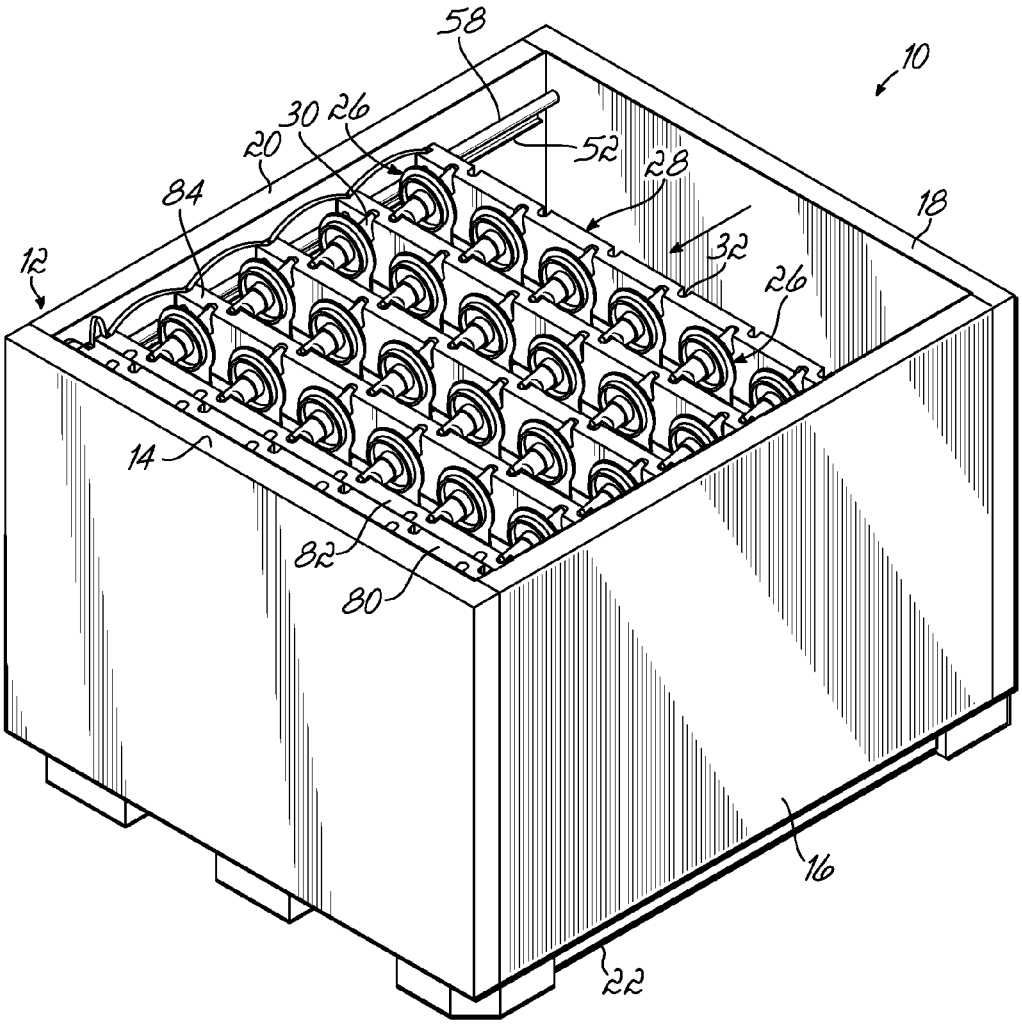
FIG. 3 is a perspective view of the reusable and returnable container shown in FIGS. 1-2 after all product has been removed between two adjacent support members and the remaining support members have been moved toward the front of the container.
Figure 4:
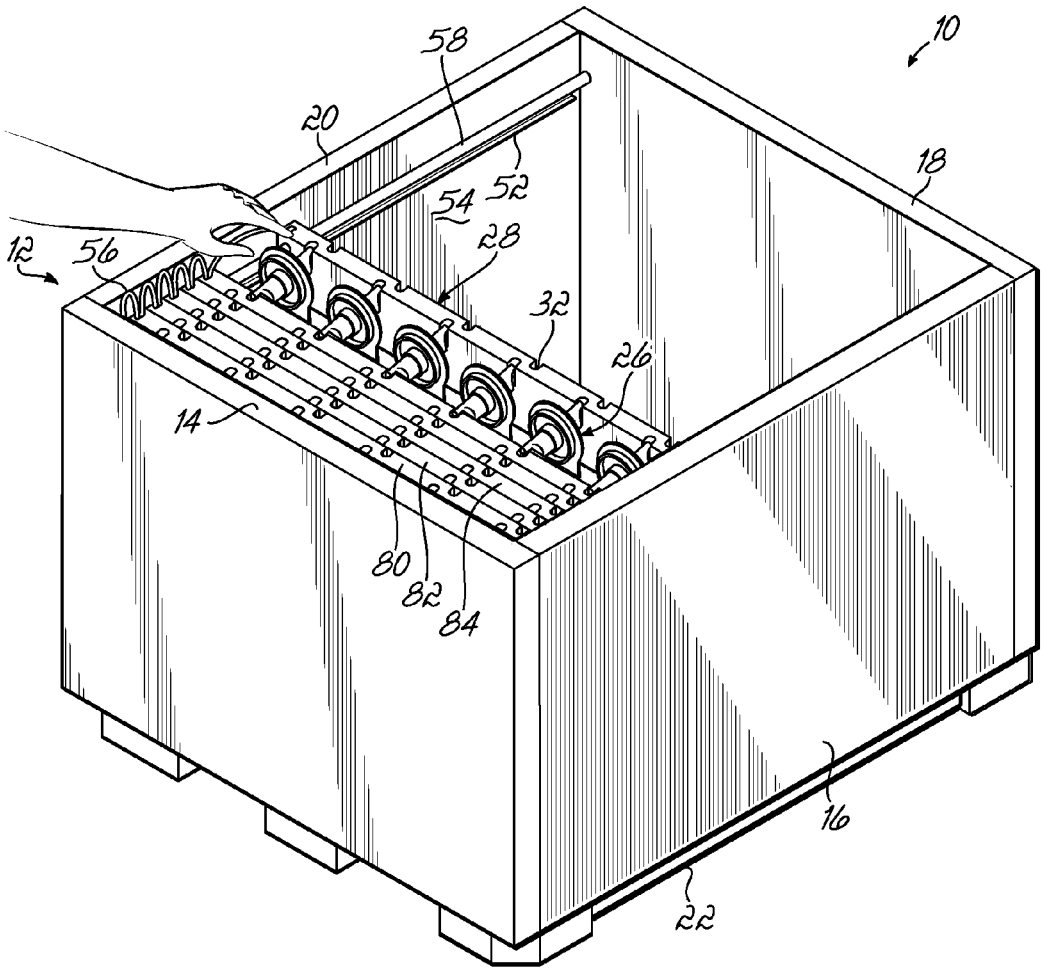
FIG. 4 is a perspective view of the reusable and returnable container shown in FIGS. 1-3 after all but one row of product has been removed and the support member assemblies have been moved to the front of the container.

According to another aspect of the present invention, the reusable and returnable container 10 may also have at least one space limiter 56 which, as shown in FIGS. 1, 2 and 3, limits the distance the support members 28 may be moved away from one another due to the fact that each space limiter 56 is secured to each support member 28. Typically, the length or distance of the space limiter 56 between locations where the space limiter 56 is secured to the support members 28 will be fixed to prevent the support members 28 from moving farther apart than necessary for the insertion of product 26 between adjacent support members 28. The space limiter 56 may be secured to the upper surfaces 31 of the support members 28 in any suitable fashion including, but not limited to, gluing, fastening, etc. Of course, when the support members 28 are moved or rolled to a position adjacent to one another, i.e., in contact, as shown in FIG. 4, the flexibility of the space limiters 56 allows for such movement. The space limiter 56 as shown, is preferably comprised of a plastic strap, but may be made of any other suitable material.

Figure 1A:
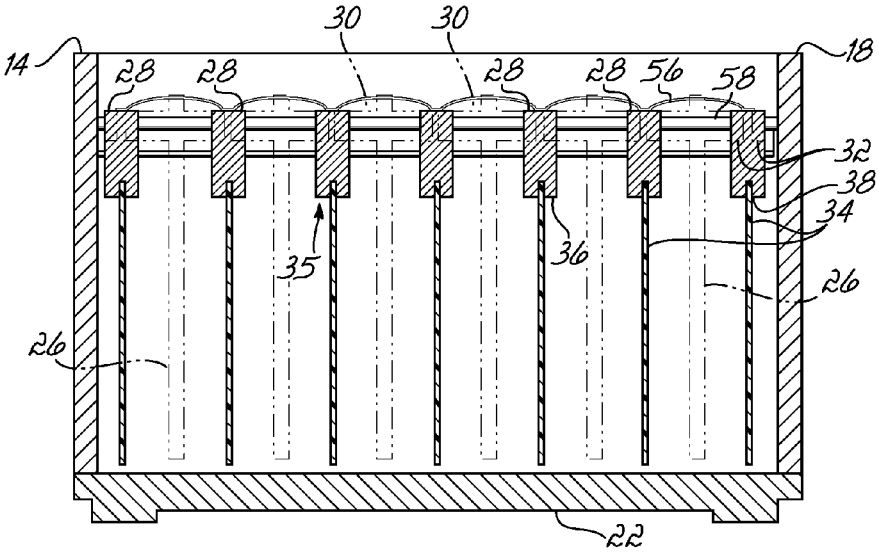
FIG. 1A is a cross-sectional view of the reusable and returnable container shown in FIG. 1 with the product shown in dashed lines.

The embodiment of the container 10 shown in FIG. 1A also has a pair of stabilizers 58. Each stabilizer 58 passes through an aperture or opening 60 in each of the support members 28. The stabilizers 58 are positioned within the apertures 60 of the support members 28 so that the support members 28 may freely slide back and forth relative to the stabilizers 58. See FIG. 5A. The stabilizers 58 may or may not be attached to the walls of the container 10. The stabilizers 58 prevent the support members 28 from rotating relative to a horizontal axis A. See FIG. 1. If one or more of the support members 28 were to rotate, the distance between adjacent product receptacles 32 would decrease due such rotation, thereby allowing product 26 to become dislodged from the support members 28 and fall between adjacent support members 28 inside the container 10. In the embodiment shown, each stabilizer 58 comprises a rod or a tube, or the like. However, it may be any other mechanism which prevents or inhibits rotation of the support members 28.

Figure 6:
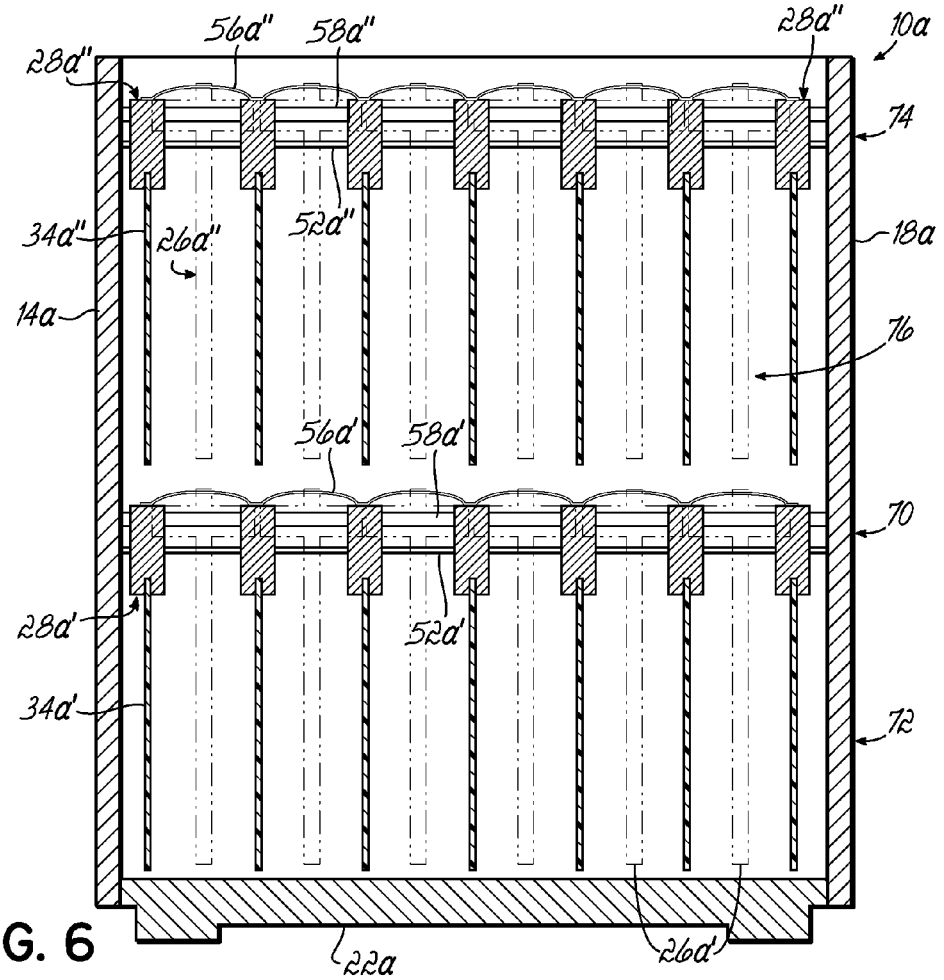
FIG. 6 is a cross-sectional view of an alternative embodiment of a reusable and returnable container having multiple layers of product.

An alternative embodiment of container 10*a* having a front wall 14*a*, a side wall (not shown), a rear wall 18*a* and another side wall (not shown), all extending upwardly from a base 22*a* is shown in FIG. 6. This container 10*a* has multiple layers of product suspended from support members 28*a*', 28*a*" having product receptacles (not shown), the support members 28*a*', 28*a*" being supported by sets of parallel tracks 52*a*', 52*a*" as described above. In this embodiment, a lower layer 70 of support members 28*a*' are adapted to move from back to front inside the interior of the container 10*a* in a manner described above. Lower stabilizers 58*a*' pass through holes in the support members 28*a*' as described above. Dividers 34*a*' are secured to and extend downwardly from the support members 28*a*' as described above. Lower space limiters 56*a*' limit the distance the support members 28*a*' may separate from each other. A lower layer 72 of products 26*a*' are supported from the lower support members 28*a*' in a manner described hereinabove.

An upper layer 74 of support members 28*a*" are adapted to move from back to front inside the interior of the container 10*a* in a manner described above. Upper stabilizers 58*a*" pass through holes in the support members 28*a*" as described above. Dividers 34*a*" are secured to and extend downwardly from the support members 28*a*" as described above. Lower space limiters 56*a*" limit the distance the support members 28*a*" may separate from each other. An upper layer 76 of products 26*a*" are supported from the upper support members 28*a*" in a manner described hereinabove.

In any of the embodiments of the present invention, at least one wall of the container may be configured so as to allow an upper portion thereof to open outwardly, thereby furthering access to the products therein. Such an adaptation may be particularly helpful in gaining access to products in embodiments having multiple layers of product. Additionally, if desired, a portion of any of the walls of the container may be omitted or collapsible.

Figure 7:
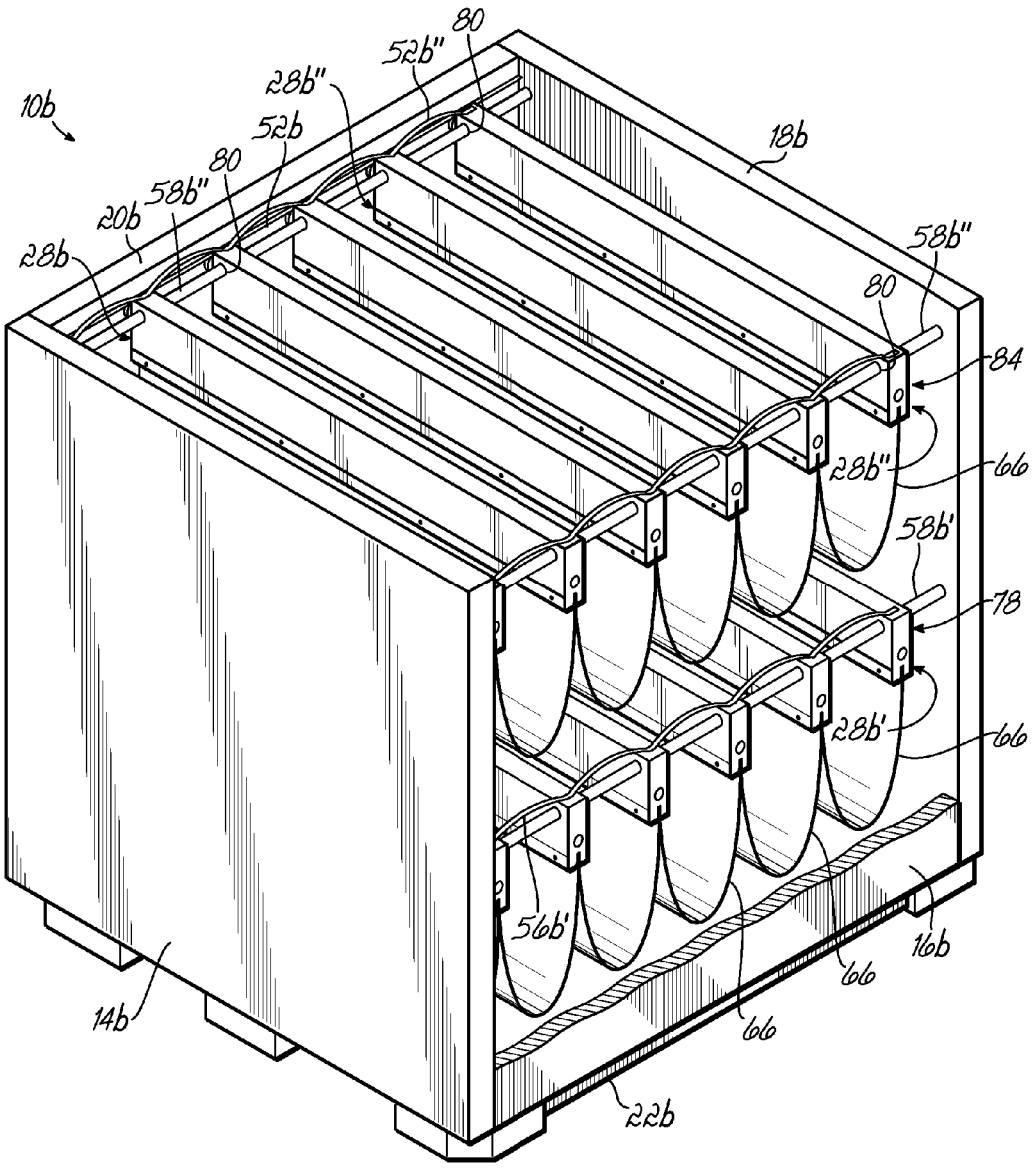
FIG. 7 is a perspective view of another embodiment of the reusable and returnable container having multiple layers of product.

FIG. 7 shows an alternative embodiment of container 10*b* having a front wall 14*b*, a side wall 16*b*, a rear wall 18*b* and another side wall 20*b*, all extending upwardly from a base 22*b*. This container 10*b*, like container 10*a* shown in FIG. 6, has multiple layers of support members 28*b* which are supported by sets of parallel tracks 52*b*. In this embodiment, the support members 28*b* preferably lack product receptacles, but may have them if desired or necessary. Product (not shown) is located in hanging pouches 66 secured to the support members 28*b* rather than suspended from the support members in the manner described above. The hanging pouches may assume other shapes or configurations if desired, and may be suspended from the support members in any desired manner.

In this embodiment, a lower layer 78 of support members 28*b*' are adapted to move from back to front inside the interior of the container 10*b* in a manner described above. Lower stabilizers 58*b*' pass through holes 80 in the support members 28*b*' as described above. Lower space limiters 56*b*' limit the distance the lower support members 28*b*' may separate from each other. A lower layer 82 of products (not shown) are supported from the pouches 66 extending downwardly from the lower support members 28*b*'.

Referring to FIG. 7, an upper layer 84 of support members 28*b*" are adapted to move from back to front inside the interior of the container 10*b* in a manner described above. Upper stabilizers 58*b*" pass through holes 80 in the support members 28*b*" as described above. Upper space limiters 56*b*" limit the distance the support members 28*b*" may separate from each other. An upper layer of products (not shown) are supported from the pouches 66 extending downwardly from the upper support members 28*b*". Although pouches are shown, other forms of known dunnage may be used in accordance with any of the embodiments of the present invention.

Figure 5D:
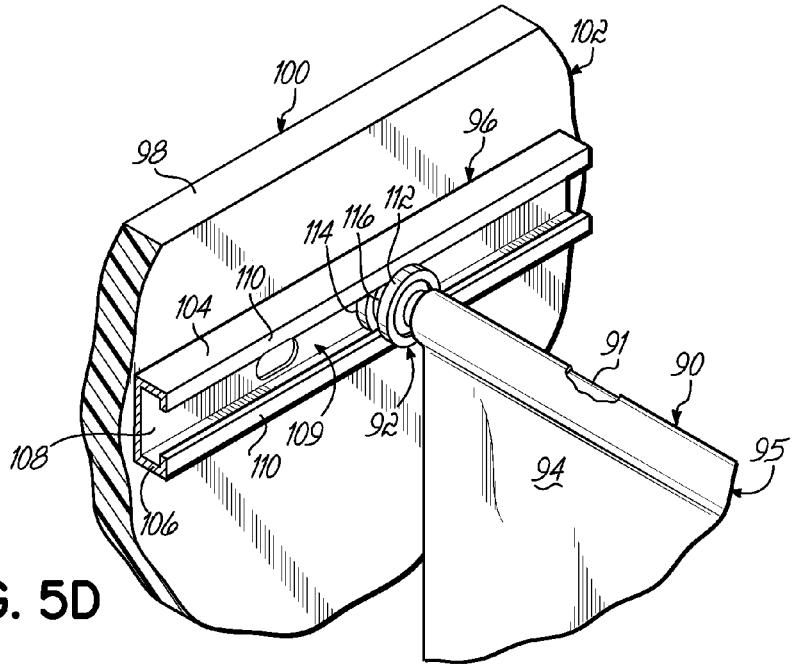
FIG. 5D is a perspective view of a portion of an alternative support member assembly showing a different type of roller at the end of the support member, the roller being in a track attached to the body of the container.

FIG. 5D shows another alternative embodiment of the present invention in which each support member 90 has a pair of opposed end members or rollers 92 (only one being shown) secured at opposed ends of a support 91. The end members 92 are preferably made of injection molded plastic, but may be made of any suitable material. A pouch 94, like pouch 66 shown in FIG. 7, is supported by two adjacent support members 90. The fabric of the pouch 94 is sewn or otherwise secured together to make a pocket 95 in which is located the support 91 of the support member 90.

As seen in FIG. 5D, tracks 96 are secured to opposed side walls 98 of the body 100 of the container 102. Each track 96 has an upper wall 104, a lower wall 106 joined to the upper wall 104 by a side wall 108 and a lip 110 extending downwardly from the upper wall 104 and another lip 110 extending upwardly from the lower wall 106 defining an interior 109 of the track 96. Each end member 92 of each support member 90 is adapted to engage and move along one of the tracks 96. Each end member 92 has a first or inside portion 112 and a second or outside portion 114 with a groove 116 therebetween. The end members 92 preferably rotate along the length or width of the tracks 96; however, the end members 92 may slide rather than rotate along the tracks 96. The outside portion 114 of the end member 92 preferably rotates inside the interior 109 of the track 96, and the inside portion 112 rotates outside of the interior 109 of the track 96, the groove 116 of the end portion 92 contacting the lips 110 of the track 96.

Although the particular track and roller arrangement or configuration illustrated in FIG. 5D is described above with respect to a hanging pouch embodiment, like the one shown in FIG. 7, it may be used in any embodiment of the present invention, including the embodiment illustrated in FIG. 1.

Figure 8:
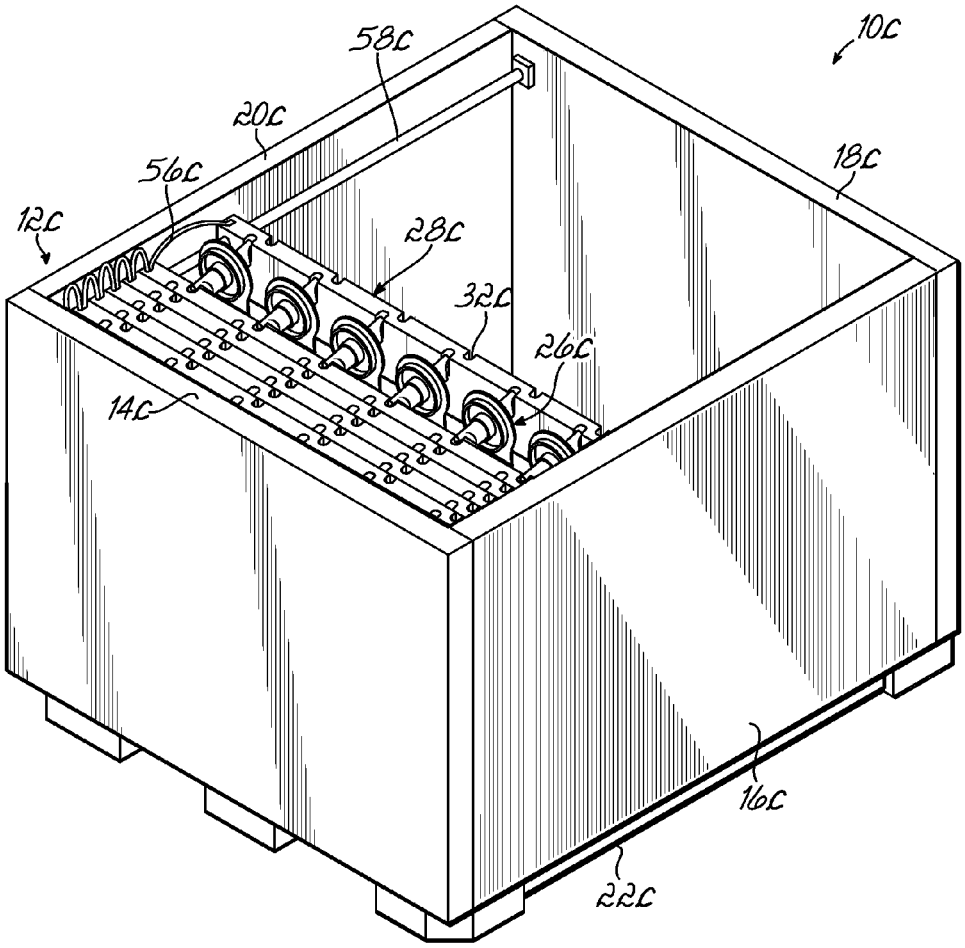
FIG. 8 is a perspective view of another embodiment of the reusable and returnable container having no rollers.

FIG. 8 shows another alternative embodiment of container 10*c* having a body 12*c* including a front wall 14*c*, a side wall 16*c*, a rear wall 18*b* and another side wall 20*c*, all extending upwardly from a base 22*c*. This container 10*c*, like container 10 shown in FIG. 1, has a single layer of support members 28*c* which are supported by stabilizers 58*c* and slidable thereon. In this embodiment, the support members 28*c* lack rollers or their equivalent because they are not necessary. Product 26*c* is suspended from product receptacles 32*c* formed in the support members 28*c*. Space limiters 56*c* limit the distance the support members 28*c* may separate from each other in the manner described above.

Although the embodiment shown in FIG. 8 has a single layer or level of support member assemblies, this embodiment of the present invention in which the support member assemblies lack rollers may be used in a multi-level container, such as the containers shown in FIGS. 6 and 7. In such embodiments, one or more levels of support member assemblies may slide on stabilizers as shown in FIG. 6 without any rollers or tracks.

Operationally, the method of unloading product from the container 10 comprises the steps of removing a first row of products 26, as shown in FIG. 2, suspended between a first or proximal support member 80 (see FIGS. 3 and 4) and a second or medial support member 82. The second support member 82 is then moved or rolled alongside the first support member 80 so that the first and second support members 80, 82, as shown in FIG. 3, are positioned nearest to the unloader (not shown). The unloader may then remove a second row of products 26 suspended between the product receptacles of the second support member 82 and the product receptacles of a third or distal support member 84. This process continues until all product has been removed from the container 10 and all of the support members 28 are pulled forwardly and resting against one another proximate the front wall 14 of the container 10. As shown in FIG. 4, to remove the last or rearmost row of products, the operator need only reach a limited distance over the container or into the container.

In an embodiment where the container has multiple layers of product, as shown in FIGS. 6 and 7, when all product is removed from the upper layers, the upper support members may then be moved to a position farthest from the unloader exposing a lower layer of products suspended or supported, at least in part, by support member assemblies, whereby the process of removing product and moving a new row of product closer to the unloader is repeated.

FIGS. 9, 10, 11 and 12 illustrate a collapsible reusable and returnable container 10*d* according to another embodiment of the present invention. The reusable and returnable container 10*d*, as shown, comprises a body 12*d* having a front wall 14*d*, a side wall 16*d*, a rear wall 18*d* and another side wall 20*d*, all extending upwardly from a base 22*d*. The walls 14*d*, 16*d*, 18*d* and 20*d* of container 10*d* are hinged to the bottom 22*d* of the container 10*d* to be more easily erected and/or compacted for storage. See FIGS. 11 and 12. Although one type of collapsible container is illustrated, the present invention may be used with other types or configurations of collapsible containers. This embodiment of the present invention may also be used in a rack-type of container which has corner posts extending upwardly from a base. See FIG. 13A. The term "wall", for purposes of this document, is not intended to be limited to a solid wall. For example, each wall may comprise two vertical posts joined together in any desired manner. A cover (not shown) may also be included to enclose the container 10*d* and further protect and secure product (not shown) during shipment. If desired, one or more walls may be partially or entirely omitted, for example, in a horizontal dispensing container.

Tracks 52*d* are secured to opposed side walls 16*d*, 20*d* of the body 12*d* of the container 10*d* in any desired manner. As best illustrated in FIG. 10, each track 52*d* has an upper wall 104*d*, a lower wall 106*d* joined to upper wall 104*d* by a side wall 108*d* and lips 110*d* extending downwardly from the upper wall 104*d* and upwardly from the lower wall 106*d*, thereby defining an interior 109*d* of the track 52*d*.

Figure 9:
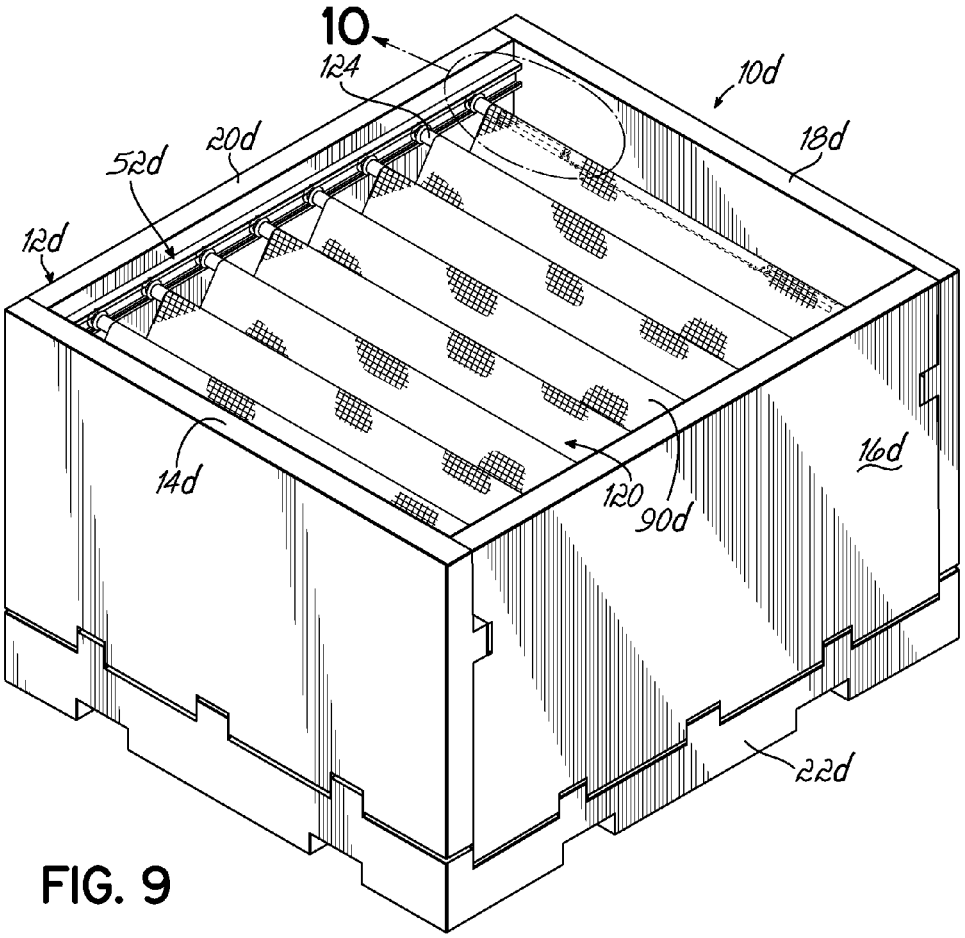
FIG. 9 is a perspective view of a collapsible reusable and returnable container showing dunnage suspended by a plurality of slidable support member assemblies.

Dunnage 120 in the form of a plurality of pouches 90*d* are suspended by and supported by a plurality of support member assemblies 122. Although the dunnage 120 shown comprises pouches, the dunnage may assume other shapes or configurations. A pouch 90*d* shown in FIG. 9, is supported by two adjacent support member assemblies 122. The fabric of the pouch 90*d* is sewn or otherwise secured together along a seam 123 to make a pocket 125 in which is located a flexible support 126 of the support member assembly 122. See FIG. 10.

Figure 10:
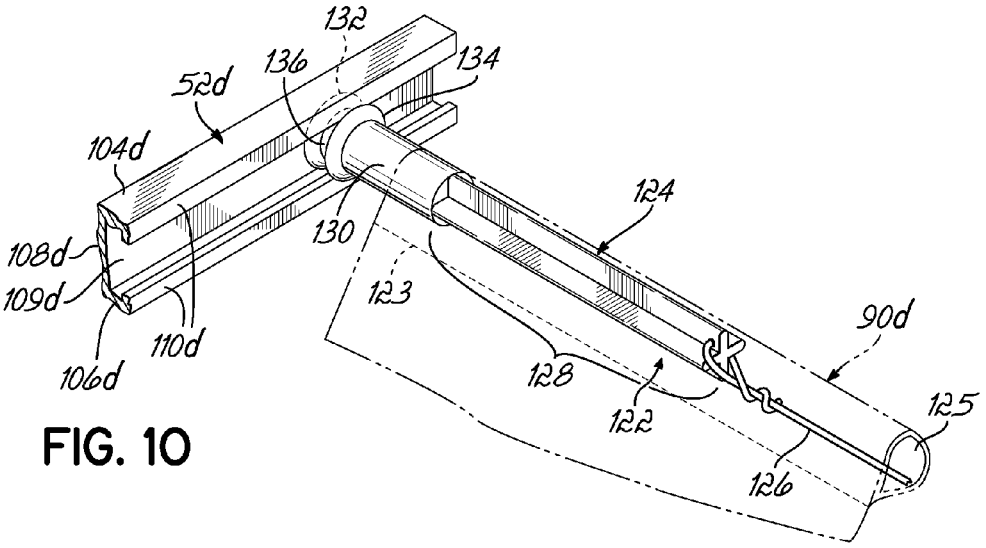
FIG. 10 is an enlarged perspective view of the encircled area 10 of FIG. 9.

As shown in FIG. 10, a support member assembly 122 includes a pair of sliders 124 and a flexible support 126 extending therebetween. The sliders 124 are preferably made of injection molded plastic, such as nylon, but may be made of any other material. The flexible support 126 is preferably a cable, but may be made of nylon or other suitable material. As shown in FIG. 10, the ends of the flexible support 126 are tied or otherwise secured to the sliders 124.

As shown in FIG. 10, each slider 124 preferably has a first portion 128 having an X-shaped cross-sectional configuration and a second portion 130 having a circular cross-sectional configuration. Although one configuration of slider 124 is illustrated, any type or configuration of slider may be used with the present invention. In this embodiment, each slider 124 has a pair of heads 132, 134 at the end of the slider 124. Head 132 is furthest from the first portion 128 of the slider 124 and head 134 is spaced inwardly from head 134. The heads 132, 134 are spaced from one another to define a groove 136 therebetween which receives and retains the lips 110*d* of the track 52*d*. As shown in FIG. 10, head 132 is located inside the interior 109*d* of track 52*d*, and head 134 is located outside the interior 109*d* of track 52*d*. Head 132 keeps the slider 124 engaged with the track 52*d*, while head 134 keeps the material of pouch 90*d* out of the interior 109*d* of the track 52*d*, thereby ensuring that the sliders 124 may move smoothly along the tracks 52*d*. Although one configuration of support member assembly 122 is illustrated, the present invention may be used with any type or configuration of support member assembly for supporting dunnage so the dunnage may slide or move inside the container.

Figure 10A:
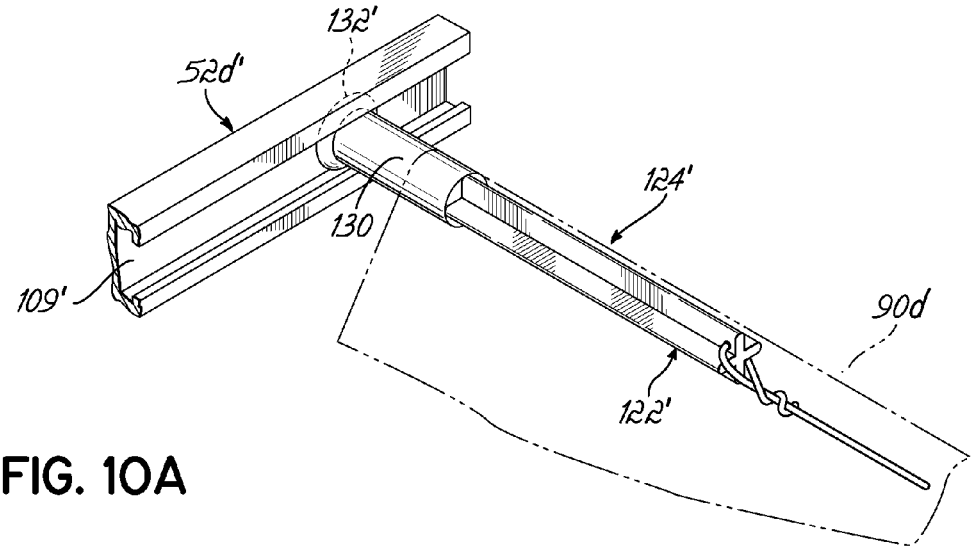
FIG. 10A is an enlarged perspective view of an alternative slider for use in a container.

FIG. 10A shows another alternative embodiment of the present invention in which each slider 124' has only one head 132', rather than a pair of heads (as shown in FIG. 10). Head 132' remains inside the interior 109' of the track 52*d'* and keeps the slider 124' engaged with the track 52*d'*.

Figure 11:
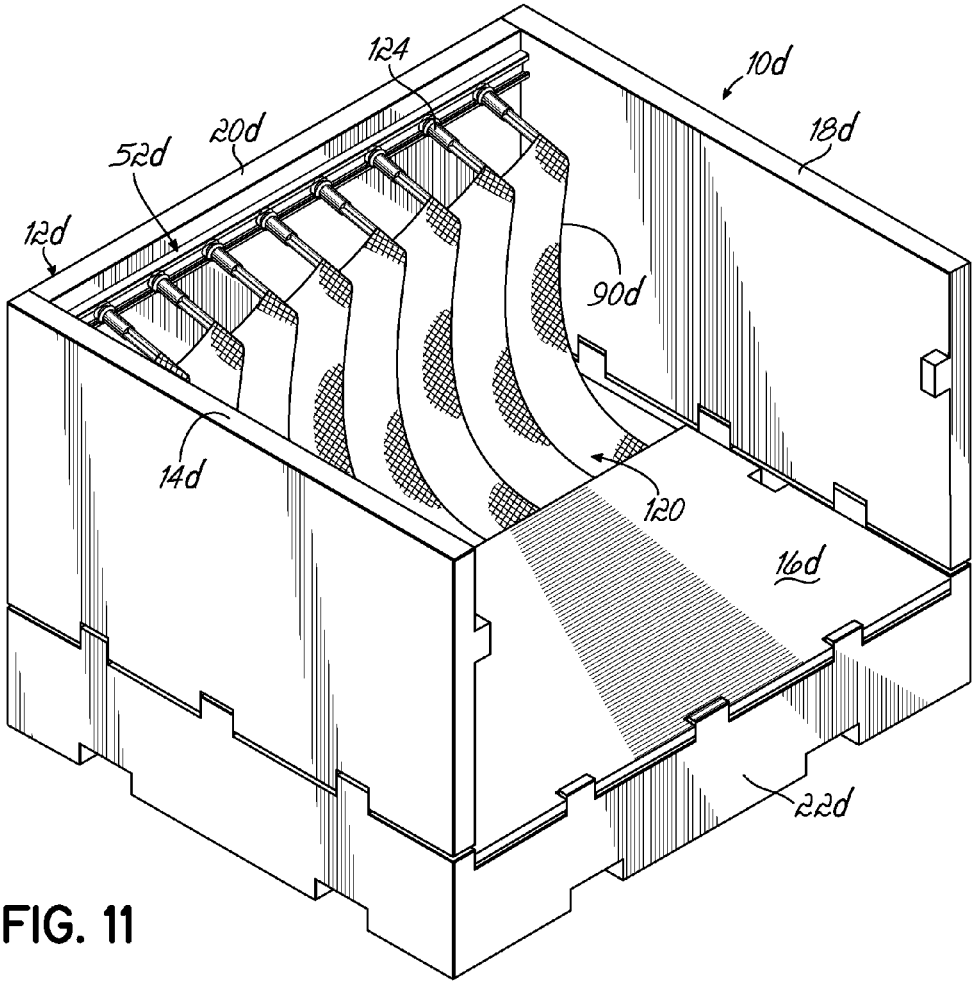
FIG. 11 is a perspective view of the reusable and returnable of FIG. 9 being collapsed.
Figure 12:
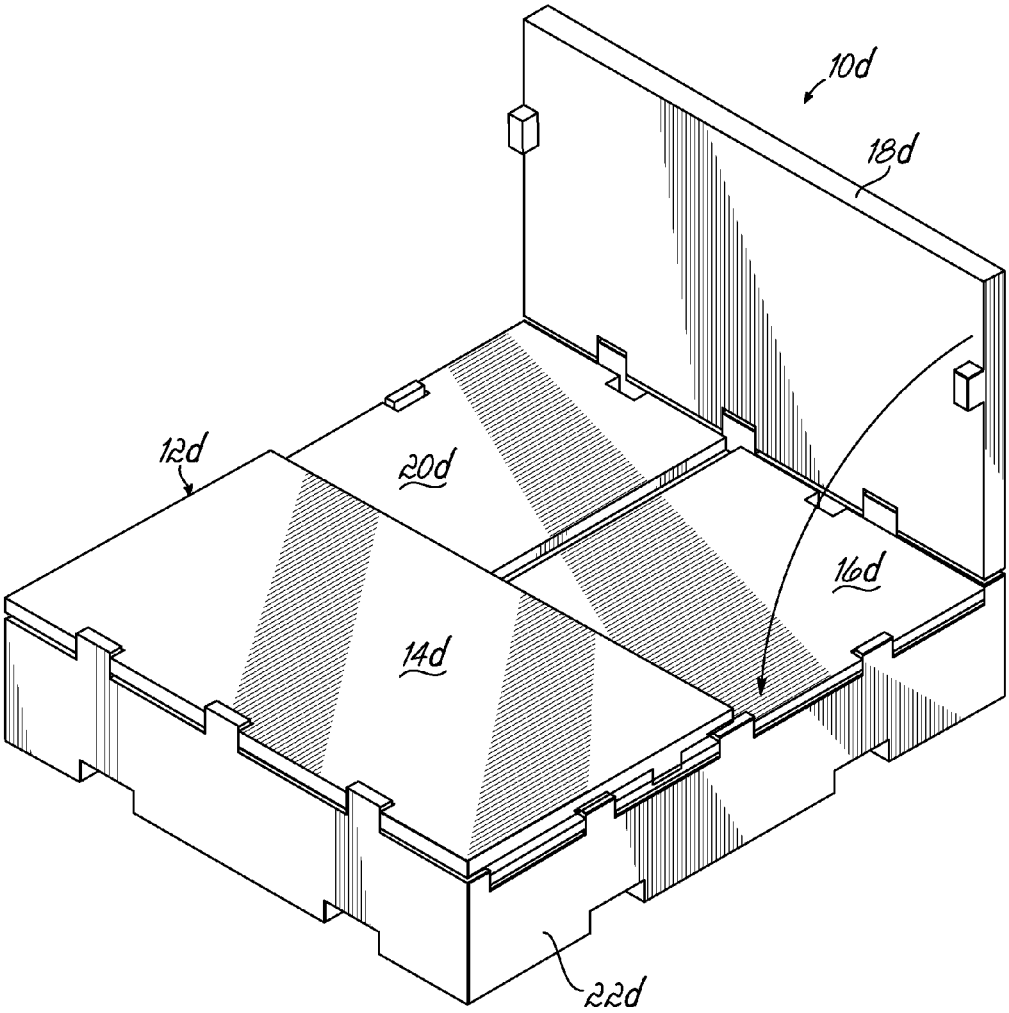
FIG. 12 is a perspective view of the reusable and returnable of FIG. 9 fully collapsed.

FIG. 11 illustrates the container 10*d* of FIG. 9 being collapsed or partially collapsed. More specifically, wall 16*d* is disengaged from erected walls 14*d* and 18*d* and swung inwardly towards the interior of the container 10*d*. As shown in FIG. 12, after walls 16*d*, 20*d* are collapsed, walls 14*d*, 18*d* are collapsed. Due to the nature of the dunnage 120 and support member assemblies 122, the dunnage is collapsed and shipped with the container.

FIG. 13 illustrates a collapsible container 10*e*, like the collapsible container 10*d* shown in FIG. 9. The collapsible container 10*e* collapses in the same manner as the container 10*d* of FIG. 9. See FIGS. 11 and 12. The reusable and returnable container 10*e*, as shown, comprises a body 12*e* having a front wall 14*e*, a side wall 16*e* (only a portion being shown), a rear wall 18*d* and another side wall 20*e*, all extending upwardly from a base 22*e* and hingedly secured to the base 22*e* for purposes of collapsing the walls. The front wall 14*e* has a drop down door 137 hinged to the remainder of the front wall 14*e* with hinges 139. The door 137 is movable between an erect position (not shown) and an open position shown in FIG. 13 to allow easy access to the interior of the container 10*e*. Any of the walls or sides of any of the containers described or shown herein may have lockable doors, like door 137 shown in FIG. 13 of any desired size or configuration. Such access doors are particularly useful in a multi-layer or multi-level container for access to the lower layer or level of dunnage and/or product.

Although one type of collapsible container is illustrated, this embodiment may be used with other types or configurations of collapsible containers. For example, this embodiment may also be used in a rack-type of container having corner posts extending upwardly from a base. See FIG. 13A. A cover (not shown) may also be included to enclose the container 10*e* and further protect and secure product (not shown) during shipment. If desired, in this embodiment, one or more walls may be partially or wholly omitted, for example, in a horizontal dispensing container.

Container 10*e* has multiple layers of dunnage 120*e* in the form of pouches 90*e* for supporting product (not shown) suspended therefrom. Although each layer or level of dunnage 120*e* is shown as being multiple pouches 90*e* formed or created from one piece of material draped or laying over and secured to the support member assemblies 122 as shown in FIG. 10 and described above, it is within the present invention that each pouch be made from its own piece of material, in which case the pouches would not be interconnected. However, one advantage of having multiple pouches 90*e* being formed of one piece of material and secured to support member assemblies 122 as shown in FIG. 13 is that an operator (not shown) may pull an entire layer or group of pouches 90*e* by pulling only one support member assembly 122 or more towards the operator. Thus, the fabric of the pouches 90*e* acts like the space limiter 56 shown in FIG. 1 and described above. This is true for any of the embodiments described in this document.

Multiple tracks 52*e* are secured to opposed walls 16*e*, 20*e* in any desired manner at different spaced vertical heights, levels or locations. Although two layers of dunnage are illustrated in FIG. 13, any number of layers of tracks may be incorporated into collapsible container 10*e*. In this embodiment, a lower layer 136 of support members 122*e* supporting pouches 90*e* are adapted to move from back to front inside the interior of the container 10*e* in a manner described above. Similarly, an upper layer 138 of support members 122*e* supporting pouches 90*e* are adapted to move from back to front inside the interior of the container 10*e* in a manner described above.

Figure 13A:
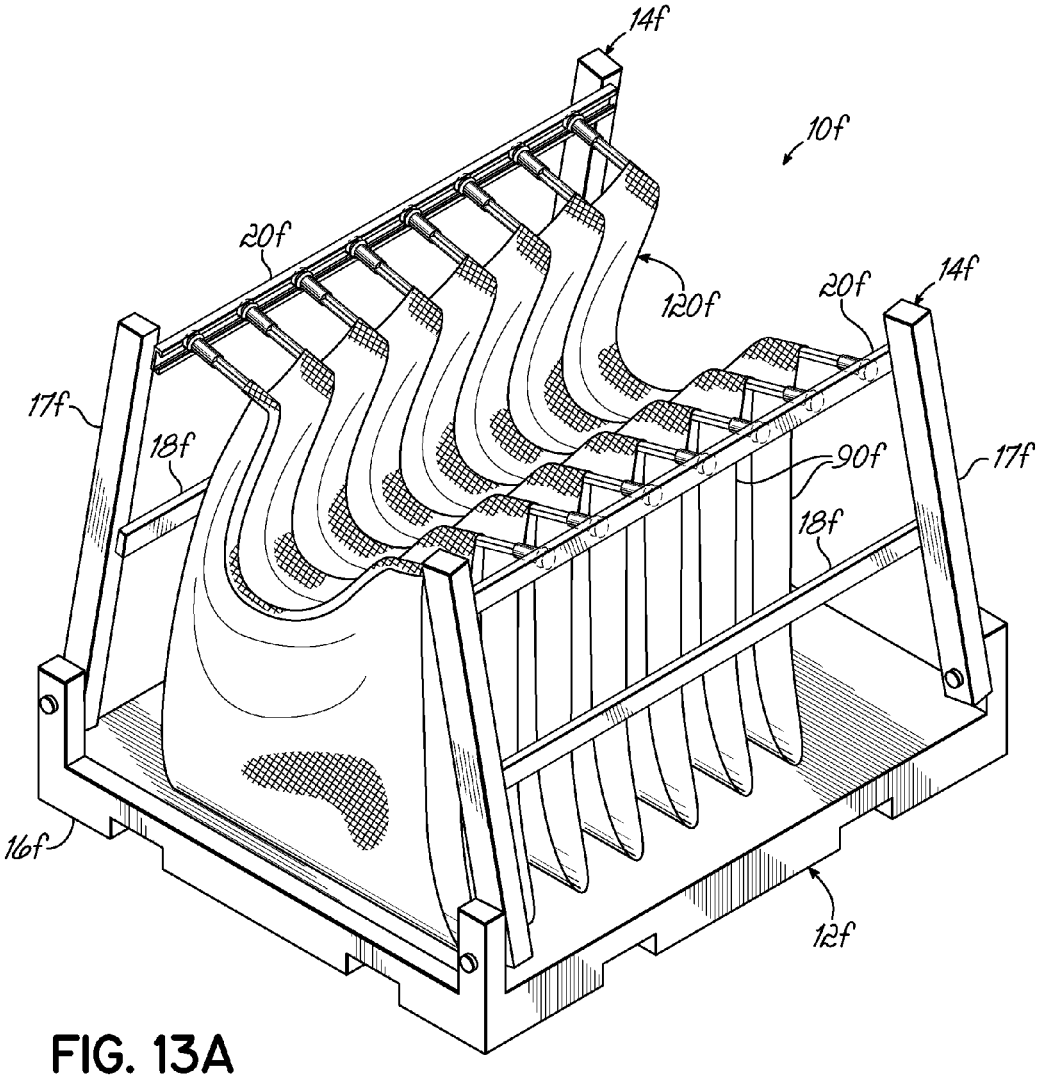
FIG. 13A is a perspective view of another embodiment of collapsible reusable and returnable container showing dunnage suspended by a plurality of support member assemblies.

FIG. 13A illustrates a collapsible container 10*f* which collapses in a similar manner as the other containers illustrated and described above. The reusable and returnable container 10*f*, as shown, comprises a body 12*f* having a opposed side walls or structures 14*f* extending upwardly from a base 16*f* and hingedly or pivotally secured to the base 16*f* for purposes of collapsing the walls 14*f*. Each side structure 14*f* comprises a pair of corner posts 17*f* joined together with structural members 18*f* and/or rails or tracks 20*f*. Although FIG. 13A illustrates only one set of rails or tracks 20*f*, multiple layers of tracks may be incorporated into such a container to create a multi-level container like those shown and described above.

Container 10*f* has a single layer of dunnage 120*f* in the form of pouches 90*f* for supporting product (not shown) suspended therefrom. Multiple tracks 20*f* are secured to corner posts 16*f* in any desired manner at any desired vertical height. level or location. Although one layer of dunnage is illustrated in FIG. 13A, any number of layers of tracks may be incorporated into collapsible container 10*f*. In this embodiment, support member assemblies 122*f* supporting pouches 90*f* are adapted to move from back to front inside the interior of the container 10*f* in a manner described above. If desired, in this embodiment, depending on the dunnage, the container may be a horizontal dispensing container, rather than a vertical dispensing container.

FIGS. 14, 15, 15A and 16 illustrate a non-collapsible container 10*g*, similar to the collapsible container 10*e* shown in FIG. 13. The container 10*g*, as shown, comprises a body 12*g* having a front wall 14*g*, a side wall 16*g* (only a portion being shown), a rear wall 18*g* and another side wall 20*g*, all extending upwardly from a base 22*g*. Although one type of non-collapsible container is illustrated, this embodiment may be used with other types or configurations of containers. For example, this embodiment may also be used in a rack-type of container having corner posts extending upwardly from a base. A cover (not shown) may also be included to enclose the container 10*g* and further protect and secure product (not shown) during shipment. If desired, in this embodiment, one or more walls may be partially or wholly omitted, for example, in a horizontal dispensing container.

Container 10*g* has multiple layers of dunnage 120*g* in the form of pouches 90*g* for supporting product (not shown) suspended therefrom. Multiple tracks 52*g* are secured to opposed walls 16*g*, 20*g* in any desired manner at different spaced vertical heights, levels or locations. Like tracks 52*d* shown in FIG. 10, each track 52*g* has an upper wall 104*g*, a lower wall 106*g* joined to upper wall 104*g* by a side wall 108*g* and lips 110*g* extending downwardly from the upper wall 104*g* and upwardly from the lower wall 106*g*, thereby defining an interior 109*g* of the track 52*g*. Other configurations or shapes of track may used if desired.

Although two layers of dunnage are illustrated in FIG. 13, any number of layers of tracks may be incorporated into container 10*g* to create multiple levels or layers of dunnage. In this embodiment, a lower layer 140 of support member assemblies 122*g* supporting pouches 90*g* are adapted to move from back to front inside the interior of the container 10*g* in a manner described above. Similarly, an upper layer 142 of support member assemblies 122*g* supporting pouches 90*g* are adapted to move from back to front inside the interior of the container 10*g* in a manner described above.

Figure 15:
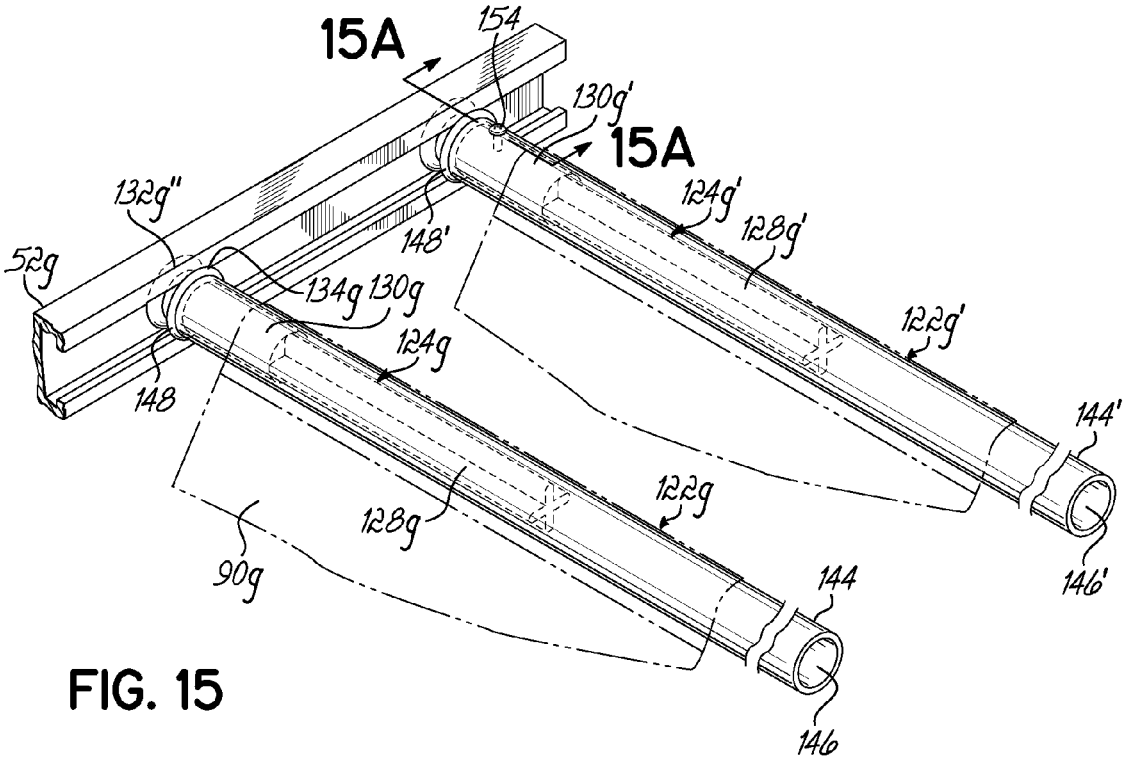
FIG. 15 is an enlarged view of the encircled area 15 of FIG. 14.
Figure 15A:
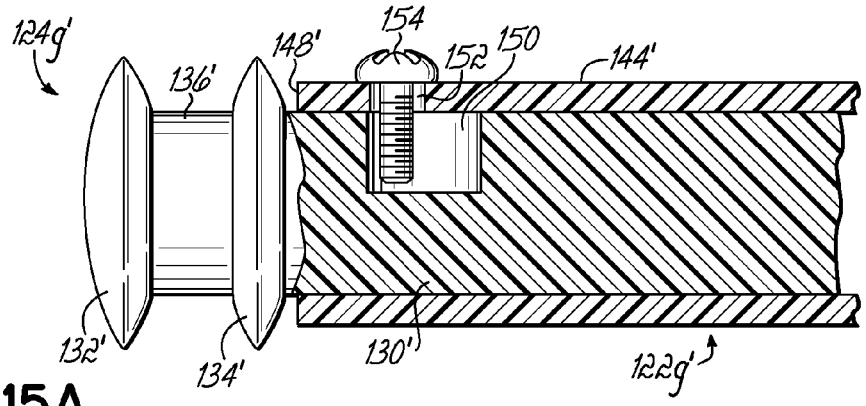
FIG. 15A is a view taken along the line 15A-15A of FIG. 15.

As best shown in FIGS. 15 and 15A, a support member assembly 122*g* includes a pair of sliders 124*g* like sliders 124 shown in FIG. 10 and described above. The support member assembly 122*g* further comprises a tubular support 144 having a hollow interior 146 extending therebetween. The tubular support 144 is preferably made of metal, but may be made of other suitable material, such as plastic. As shown in FIG. 15, each end of tubular support 144 fits over at least one portion 128*g* of a slider 124*g*. An end surface 148 of tubular support 144 abuts head 134*g* of slider 124*g*.

As best shown in FIG. 15A, some of the support member assemblies 122*g*' used in the container 10*g* include a pair of sliders 124*g*', as shown in FIG. 15A, which are slightly different than sliders 124*g* described above. The only difference between sliders 124*g* and 124*g*' is that sliders 124*g*' have a groove 150 formed in a portion 130*g*' therein. See FIG. 15A. Support member assemblies 122*g*' further include a tubular support 144' having a hollow interior 146' extending therebetween. The tubular support 144' is preferably made of metal, but may be made of other suitable material, such as plastic. As shown in FIG. 15A, each end of tubular support 144' fits over at least one portion 128*g*' of a slider 124*g*'. An end surface 148' of tubular support 144' abuts head 134*g*' of slider 124*g*'. As shown in FIG. 15A tubular support 144' has holes 152 therethrough which receive fasteners 154. Although fasteners 154 are shown as screws, they may be any other type of fasteners. The fasteners 154 prevent separation of the tubular support 144' from the sliders 124*g*', while allowing some movement therebetween as the fastener 154 moves within the groove 150 formed in the sliders 124*g*'.

Figure 14:
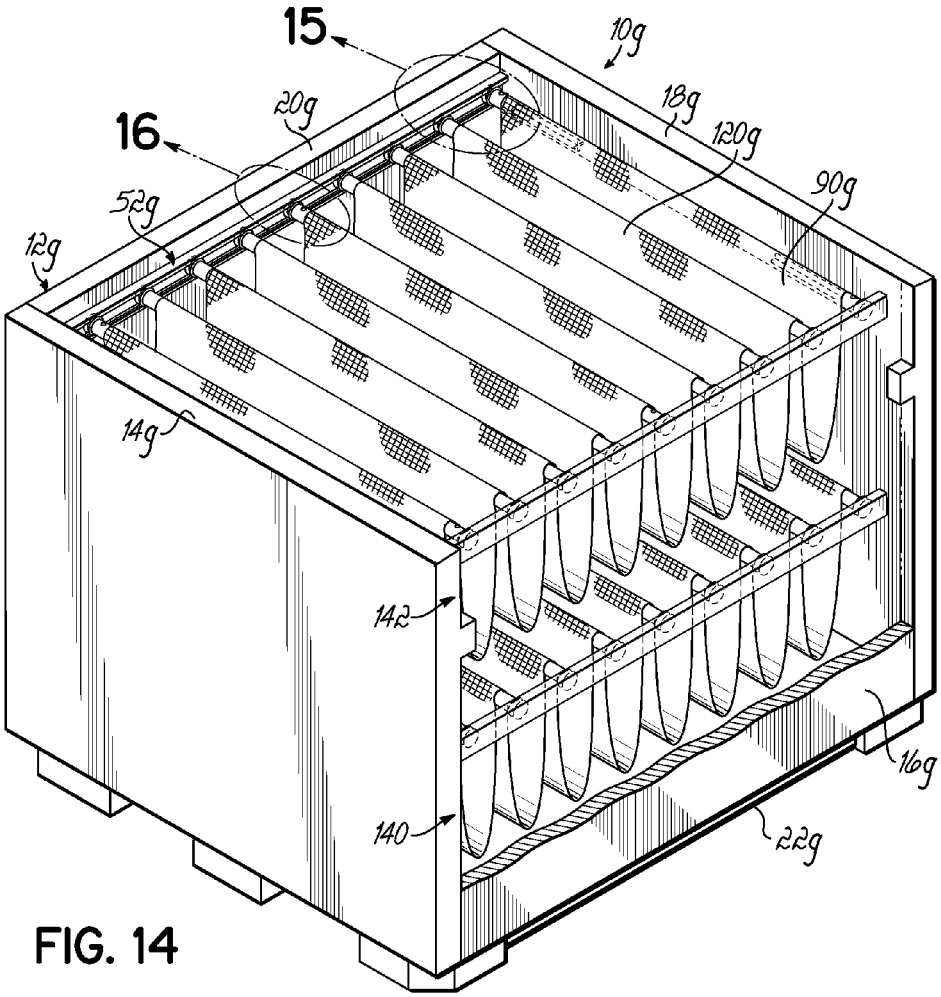
FIG. 14 is a perspective view of a non-collapsible container showing multiple layers of dunnage suspended by a plurality of support member assemblies having tubular supports.

As one skilled in the art will appreciate, the increased number of parts of support member assemblies 122*g*' increases the cost and time of assembly of support member assemblies 122*g*' when compared to support member assemblies 122*g*. Consequently, only a few support member assemblies used inside a container, like container 10*g*, need have the tubular support 144' secured to the sliders 124*g*', like in support member assemblies 122*g*'. The remaining support member assemblies may be like support member assembly 122*g*, with no fasteners 154. For example, FIG. 14 illustrates three of the nine support member assemblies having fasteners 154, like in support member assembly 122*g*' shown in FIG. 15A.

Figure 16:
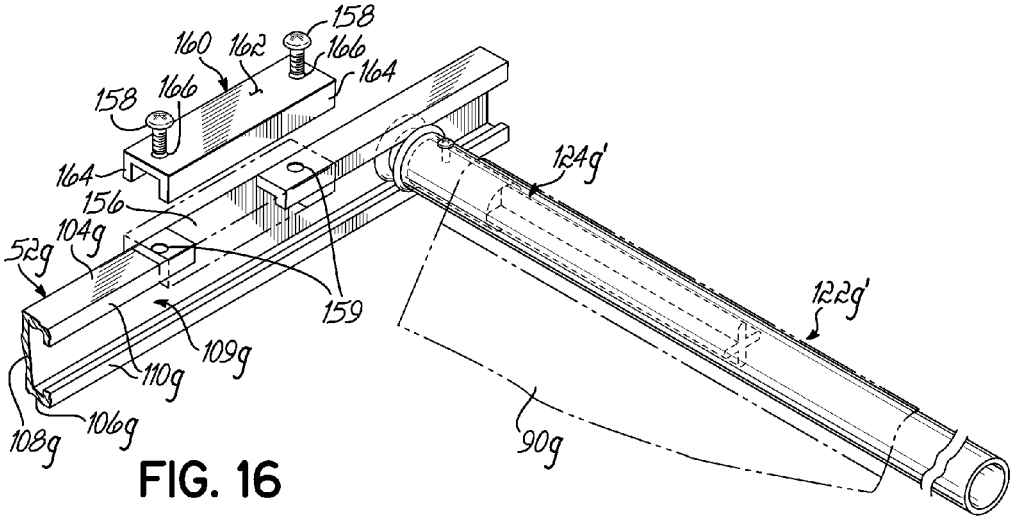
FIG. 16 is an enlarged view of the encircled area 16 of FIG. 14.

FIG. 16 illustrates another support member assembly 122*g*' exactly like the one shown in FIG. 15A used to support one of the pouches 90*g*. However, FIG. 16 illustrates another innovative feature or aspect of the present invention. Rail 52*g* has an opening or cut-out 156 formed therein. A pair of holes 158 are formed in the upper wall 104*g* of rail 52*g*, which are sized and threaded to receive fasteners 158. Although fasteners 158 are illustrated to be screws, they may be any other desirable fastener. A cap 160 is removably secured to the rail 52*g* to cover the opening or cut-out 156 formed in an upper portion of rail 52*g*. As best seen in FIG. 16, cap 160 has a generally inverted U-shaped cross-sectional configuration including a top portion 162 and side portions 164 extending downwardly from the top portion 162. Holes 166 are formed through the top portion 162 of the cap 160 and sized to receive fasteners 158 as shown in FIG. 16. The fasteners 158 are adapted to pass through the holes 166 in the cap 160 and into the holes 159 in the upper wall 104*g* of the rail 54*g*.

When one of the sliders 124*g*, 124*g*' or any part of support member assemblies 122*g*, 122*g*' are damaged or need to be replaced for any reason, one may remove cap 160 after loosening fasteners 158, thereby exposing the opening or cut-out 156 of rail 52*g*. The support member assemblies 122*g*, 122*g*' are then removed as necessary to fix the damaged part or parts.

Figure 17:
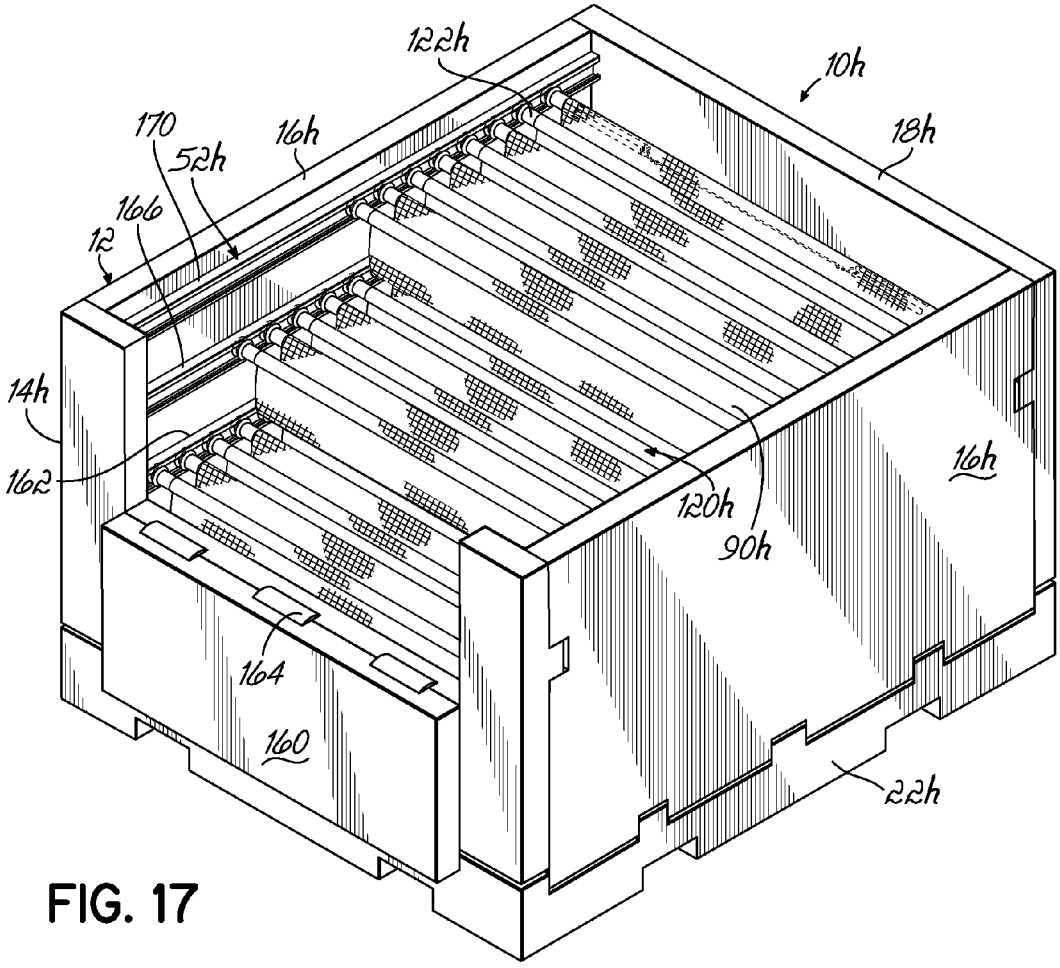
FIG. 17 is a perspective view of another embodiment of collapsible reusable and returnable container showing dunnage suspended by a plurality of support member assemblies.

FIG. 17 illustrates a collapsible container 10*h* comprising a body 12*h* having a front wall 14*h*, opposed side walls 16*h* and a rear wall 18*h*, all extending upwardly from a base 22*h*. Although one type of collapsible container is illustrated in FIG. 17, this embodiment may be used with other types or configurations of containers. For example, this embodiment may also be used in a rack-type of container having corner posts extending upwardly from a base as shown in FIG. 13A. A cover (not shown) may also be included to enclose the container 10*h* and further protect and secure product (not shown) during shipment. If desired, in this embodiment, one or more walls may be partially or wholly omitted, for example, in a horizontal dispensing container.

As shown in FIG. 17, the front wall 14*h* has a drop-down door 160 hinged to the remainder of the front wall 14*h* with hinges 164. The door 160 is movable between an erect position (not shown) and an open position shown in FIG. 17 to allow easy access to the interior of the container 10*h*. Any of the walls or sides of the container may have lockable doors like door 160, shown in FIG. 17 of any desired size or configuration.

Container 10*h* has multiple layers of dunnage 120*h* in the form of pouches 90*h* for supporting product (not shown) suspended therefrom. Multiple tracks 52*h* are secured to opposed walls 16*h* in any desired manner at different spaced vertical heights, levels or locations. Each track 52*h* may be like track 52*g* shown in FIG. 16 or track 52*f* shown in FIG. 15. Other configurations or shapes of track may used if desired.

Although three layers of dunnage are illustrated in FIG. 17, any number of layers of tracks may be incorporated into container 10*h* to create multiple levels or layers of dunnage. In this embodiment, a lower layer 162 of support member assemblies 122*h* supporting pouches 90*h* are adapted to move from back to front inside the interior of the container 10*h* in a manner described above. Similarly, a middle layer 166 and an upper layer 170 of support member assemblies 122*h* supporting pouches 90*h* are adapted to move from back to front inside the interior of the container 10*h* in a manner described above.

In any of the embodiments described herein, the tracks or retainers need not be located on the side walls or structures. They may be located on the front and rear walls or structures, as long as two opposed walls or side structures support them. Similarly rails or retainers having openings covered with removable caps as shown in FIG. 16 may be used in any of the embodiments described herein.

While various embodiments of the present invention have been illustrated and described in considerable detail, it is not the intention of the applicant to restrict or in any way limit the scope of the claims to such detail. Additional advantages and modifications will readily appear to those skilled in the art. The invention in its broader aspect is, therefore, not limited to the specific details, representative system, apparatus, and method, and illustrative example shown and described. Accordingly, departures may be made from such details without departing from the spirit or scope of the applicant's general inventive concept.

What is claimed is:

1. A method of loading a container with products for shipment, the method comprising:

providing a container comprising:

a base, a front wall, a rear wall, and two side wads extending upwardly from the base and defining an open top, each of the side walls extending from the base to an upper edge of the container and being adapted to prevent side access to supporting pouches and products held in the container and prevent products from inadvertently falling through a side of the container, straight tracks supported by the side walls at upper and lower vertically spaced levels, each of the tracks having an upper wall, a lower wall and a side wall with a first lip extending downwardly from the upper wall and a second lip extending upwardly from the lower wall of the track defining an interior of the track, movable support member assemblies movable inside the container at each level and a plurality of fabric hanging pouches for holding products at each level, each of the hanging pouches extending between two adjacent support member assemblies, wherein each of the support member assemblies comprising:

a pair of end members and a tubular support extending between the end members, each of the end members being a unitary plastic member having a portion secured inside the tubular support with a fastener extending through the tubular support and being movable inside an opening in the end member, thereby enabling the end member to move relative to the tubular support of the support member assembly, each end member having a first head and a second head spaced from the first head to define a groove therebetween, the first heads of the end members moving in the interiors of the tracks secured to the container at the same level and the second heads keeping the fabric material of the pouches out of the interior of the tracks, the groove of each end member receiving and retaining the lips of one of the tracks;

moving a plurality of support member assemblies supporting an upper layer of pouches to a position away from an operator in which the pouches of the upper layer and the support member assemblies supporting the pouches of the upper layer do not interfere with loading a lower layer of pouches;

inserting product into pouches of the lower layer of pouches until fully loaded by inserting a product into a pouch of the lower layer of pouches, one at a time, and moving the loaded pouch, one at a time, away from the operator, each pouch extending between two adjacent support member assemblies; and moving all of the support member assemblies supporting the upper layer of pouches proximate the operator after the lower layer of pouches is fully loaded and inserting additional products into the pouches of the upper layer of pouches one pouch at a time and moving the loaded pouches of the upper layer of pouches away from the operator one at a time.

2. The method of claim 1 further comprising opening a door hinged to a remainder of the front wall of the container.

3. The method of claim 1 wherein moving the support member assemblies supporting the pouches of the upper layer includes keeping a portion of each of the end members inside the tubular support.

4. The method of claim 1 wherein each layer of pouches moves from front to back inside the container.

5. The method of claim 1 further comprising moving a drop down door hinged to a remainder of the front wall of the container to an open position.

6. A method of loading a container with products for shipment, the method comprising:

providing a container comprising:

a base, a front wall having a drop down door hinged to a remainder of the front wall, a rear wall, and two side walls extending upwardly from the base and defining an open top, each of the side walls extending from the base to an upper edge of the container and being adapted to prevent side access to supporting pouches and products held in the container and prevent products from falling through a side of the container, straight tracks supported by the side walls at upper and lower vertically spaced levels, each of the tracks having an interior and lips extending towards each other, and upper and lower support member assemblies movable from front to back inside the container at each corresponding level, each of the support member assemblies comprising:

a pair of end members, and a tubular support extending between the end members and surrounding portions of the end members, each of the end members being a single member having an outer head and an inner head spaced from the outer head to define a groove therebetween, the outer heads moving in the interiors of upper tracks at the same level and the inner heads being outside the interiors of the tracks, the groove of each end member receiving and retaining the lips of one of the tracks, a plurality of flexible fabric hanging pouches for supporting products at each level, each of the hanging pouches extending between two adjacent support member assemblies:

moving the drop down door to an open position to allow access to an interior of the container;

moving a plurality of upper support member assemblies supporting an upper layer of pouches away from an operator;

moving a plurality of lower support member assemblies supporting a lower layer of pouches to a position near the operator;

inserting additional products into pouches of the lower layer of pouches, until fully loaded, through the open door of the container by inserting a product into a pouch of the lower layer of pouches, one at a time, and moving the loaded pouch, one at a time, away from the operator by moving at least one of the lower support member assemblies supporting the pouch; and moving all of the upper support member assemblies supporting the upper layer of pouches proximate the operator after the lower layer of pouches is fully loaded and inserting additional products into the pouches of the upper layer of pouches one pouch at a time and moving the loaded pouches of the upper layer of pouches away from the operator one at a time;

closing the drop down door; and enabling an end member of one of the support member assemblies to move relative to the tubular support of the support member assembly by allowing a fastener extending through the tubular support to move inside a groove in the end member.

7. The method of claim 6 wherein the container has at least three vertically spaced levels.

8. The method of claim 7 further comprising unlocking the door before moving the drop down door to an open position.

9. A method of loading a container with products for shipment, the method comprising:

providing a container comprising:

a base, a front wall, a rear wall, and two side walls being adapted to prevent side access to supporting pouches and products held in the container and prevent products from falling through a side of the container, straight tracks supported by the side walls at upper and lower vertically spaced levels, each of the tracks having an interior and at least one lip, a plurality of dunnage supports movable from front to back inside the container at each level, a plurality of supporting fabric pouches extending between two adjacent dunnage supports of the same level, each of the dunnage supports being adapted to move along the tracks and remaining at the same level, each of the dunnage supports comprising:

a pair of end members, and a tubular support extending between the end members, each of the end members being a unitary member having a portion secured inside the tubular support with a fastener extending through the tubular support and being movable inside an opening in the end member, thereby enabling the end member to move relative to the tubular support of the support member assembly, each end member having an outer head and an inner head spaced from the outer head to define a groove therebetween, the outer heads moving in the interiors of tracks at the same level and the inner heads being outside the interior of the tracks, the groove of each end member receiving and retaining the at least one lip of one of the tracks;

moving all of the dunnage supports supporting an upper level of pouches to a position away from an operator in which the pouches of the upper level and the dunnage supports supporting the pouches of the upper level do not interfere with loading a lower level of pouches;

inserting at least one product into a pouch of the lower level of pouches furthest away from the operator and moving the loaded pouch of the lower level away from the operator, inserting additional products into a next corresponding empty pouch of the lower level of pouches furthest away from the operator and repeating until the lower layer of pouches is fully loaded; and moving the dunnage supports supporting the upper level of pouches proximate the operator after the lower level of pouches is fully loaded and inserting additional products into the pouches of the upper level of pouches one pouch at a time and moving the loaded pouches away from the operator one at a time.

10. The method of claim 9 further comprising opening a door hinged to a remainder of the front wall of the container.

11. The method of claim 9 wherein moving all of the dunnage supports supporting an upper level of pouches to a position away from an operator comprises pushing the dunnage supports of the upper level against the rear wall of the container.

12. The method of claim 9 wherein inserting at least one product into the pouch of the lower level of pouches furthest away from the operator and moving the loaded pouch of the lower level away from the operator comprises the operator reaching inside the container and past the support members and supporting pouches of the upper level.

13. The method of claim 9 wherein moving the dunnage supports supporting the pouches of any level includes moving the end members of the dunnage support to move relative to the tubular support of the dunnage support.

14. A method of loading a container with products for shipment, the method comprising:

providing a container comprising:

front and rear walls, and two side walls extending upwardly from a base and defining an open top, the front wall having a door hinged to a remainder of the front wall, each of the side walls being adapted to prevent side access to supporting pouches and products held in the container and prevent products from falling through a side of the container, straight tracks supported by the side walls at upper and lower vertically spaced levels, each of the tracks having an interior defined by an upper wall, a lower wall, a side wall and lips, and a plurality of dunnage supports movable inside the container at each level, and a plurality of supporting fabric pouches for holding products at each level, each of the dunnage supports being adapted to move along the tracks and support fabric pouches remaining at the same level, each of the dunnage supports comprising:

a pair of end members, and a tubular support extending between the end members, the tubular support being secured to each of the end members of the dunnage support with a fastener extending through the tubular support and being movable inside an opening in the end member, each of the end members being a piece made of plastic having a first head and a second head spaced from the first head to define a groove therebetween, the first heads of the end members moving in the interiors of the tracks secured to the container at the same level and the second heads keeping the fabric material of the pouches out of the interior of the tracks, the groove of each end member receiving and retaining the lips of one of the tracks;

moving the door to an open position to allow access to an interior of the container, moving the dunnage supports supporting an upper level of pouches to a position away from an operator in which the pouches of the upper level and the dunnage supports supporting the pouches of the upper level do not interfere with loading a lower level of pouches;

inserting at least one product into the lower level of pouches, one pouch at a time, and moving the loaded pouch away from the operator, one pouch at a time until the lower layer of pouches is fully loaded; and moving all of the dunnage supports supporting the upper level of pouches proximate the operator after the lower level of pouches is fully loaded and inserting, through the open door of the container, additional products into the pouches of the upper level of pouches one pouch at a time starting with the rearmost pouch of the upper level of pouches and moving the loaded pouches away from the operator one at a time.

15. The method of claim 14 further comprising moving the door to an erect closed position.

16. The method of claim 14 wherein moving all of the dunnage supports supporting the upper level of pouches to a position away from the operator comprises moving the dunnage supports of the upper level against the rear wall of the container.

17. The method of claim 14 wherein inserting at least one product into the lower level of pouches, one pouch at a time, and moving the loaded pouches away from the operator, one pouch at a time, includes the operator reaching inside the container and past the support members and supporting pouches of the upper level.

18. The method of claim 14 wherein moving the dunnage supports supporting the pouches of any level includes moving the end members of the dunnage support to move relative to the tubular support of the dunnage support.

* * * * *